US007128383B2

(12) United States Patent
Takahashi

(10) Patent No.: US 7,128,383 B2
(45) Date of Patent: Oct. 31, 2006

(54) LIQUID EJECTION APPARATUS WITH BI-DIRECTIONAL MOTION AND TONE MATCHING

(75) Inventor: Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 10/665,392

(22) Filed: Sep. 22, 2003

(65) Prior Publication Data

US 2004/0145616 A1 Jul. 29, 2004

(30) Foreign Application Priority Data

Sep. 19, 2002 (JP) ..... P2002-273633
Sep. 25, 2002 (JP) ..... P2002-279417

(51) Int. Cl.
*B41J 29/38* (2006.01)

(52) U.S. Cl. ..... 347/14

(58) Field of Classification Search ..... 347/44, 347/72, 14, 8, 9, 10, 19, 40, 43; 358/3.13, 358/3.18, 3.23, 1.9, 3.06, 504, 534
See application file for complete search history.

(56) References Cited

U.S. PATENT DOCUMENTS

| | | | | |
|---|---|---|---|---|
| 4,342,051 | A * | 7/1982 | Suzuki et al. | 358/3.13 |
| 5,506,696 | A * | 4/1996 | Nakano | 358/504 |
| 5,984,448 | A * | 11/1999 | Yanagawa | 347/10 |
| 6,386,674 | B1 * | 5/2002 | Corrigan et al. | 347/19 |
| 6,450,607 | B1 * | 9/2002 | Bolash et al. | 347/19 |
| 6,616,267 | B1 * | 9/2003 | Weijkamp | 347/43 |
| 6,692,096 | B1 * | 2/2004 | Otsuki et al. | 347/14 |
| 6,899,413 | B1 * | 5/2005 | Otsuka et al. | 347/40 |
| 6,905,190 | B1 * | 6/2005 | Otsuka et al. | 347/40 |
| 2002/0024558 | A1 * | 2/2002 | Fujita et al. | 347/43 |
| 2002/0196471 | A1 * | 12/2002 | Usui et al. | 358/3.13 |
| 2003/0234826 | A1 * | 12/2003 | Hosono et al. | 347/10 |

FOREIGN PATENT DOCUMENTS

| | | | |
|---|---|---|---|
| JP | 58188662 | | 11/1983 |
| JP | 64-075248 | | 3/1989 |
| JP | 3045349 | | 2/1991 |
| JP | 6-91948 | A | 4/1994 |
| JP | 6-255200 | A | 9/1994 |
| JP | 8-20135 | A | 1/1996 |
| JP | 9-286148 | A | 11/1997 |
| JP | 10-100398 | A | 4/1998 |
| JP | 10-278350 | A | 10/1998 |
| JP | 11-48468 | A | 2/1999 |
| JP | 11-254712 | A | 9/1999 |
| JP | 11-286142 | A | 10/1999 |

(Continued)

*Primary Examiner*—Stephen Meier
*Assistant Examiner*—Rene Garcia, Jr.
(74) *Attorney, Agent, or Firm*—Sughrue Mion, PLLC

(57) ABSTRACT

An apparatus for ejecting liquid that uses bi-directional motion and tone matching to form an image onto a printing material, consisting of a head member for providing nozzles which are individually associated with one of a plurality of colors of liquid; pressure fluctuation generators which generates pressure in the liquid in each nozzle, so as to eject a liquid droplet; a carriage which causes the head member to traverse, bi-directionally, the printing material; a signal generator to generate signals which a controller uses, along with the ejection pattern data, to drive the pressure fluctuation generators as the head member travels across the printing material in each direction; and a pattern data adjuster to adjust the ejection pattern as necessary to vary an ejected number of the liquid droplets per unit area.

27 Claims, 21 Drawing Sheets

FOREIGN PATENT DOCUMENTS

| | | | |
|---|---|---|---|
| JP | 11-291476 | A | 10/1999 |
| JP | 2000-1001 | A | 1/2000 |
| JP | 2000-103089 | A | 4/2000 |
| JP | 2000233496 | | 8/2000 |
| JP | 2000301810 | | 10/2000 |
| JP | 2002079668 | | 3/2002 |
| JP | 2002-144539 | A | 5/2002 |

* cited by examiner

FIG. 10

| INK WEIGHT RATIO | ID |
|---|---|
| $x < 90.5$ | 40 |
| $90.5 \leq x < 91.5$ | 41 |
| $91.5 \leq x < 92.5$ | 42 |
| $92.5 \leq x < 93.5$ | 43 |
| $93.5 \leq x < 94.5$ | 44 |
| $94.5 \leq x < 95.5$ | 45 |
| $95.5 \leq x < 96.5$ | 46 |
| $96.5 \leq x < 97.5$ | 47 |
| $97.5 \leq x < 98.5$ | 48 |
| $98.5 \leq x < 99.5$ | 49 |
| $99.5 \leq x < 100.5$ | 50 |
| $100.5 \leq x < 101.5$ | 51 |
| $101.5 \leq x < 102.5$ | 52 |
| $102.5 \leq x < 103.5$ | 53 |
| $103.5 \leq x < 104.5$ | 54 |
| $104.5 \leq x < 105.5$ | 55 |
| $105.5 \leq x < 106.5$ | 56 |
| $106.5 \leq x < 107.5$ | 57 |
| $107.5 \leq x < 108.5$ | 58 |
| $108.5 \leq x < 109.5$ | 59 |
| $109.5 \leq x$ | 60 |

FIG. 11

| | ARRAY (BK) | ARRAY (C) | ARRAY (M) | ARRAY (Y) | DESIGN VALUE |
|---|---|---|---|---|---|
| INK WEIGHT (ng) | 20 | 21 | 18 | 21 | 20 |
| COLOR ADJUST ID | 50 | 55 | 40 | 55 | |

BK ARRAY ID : 20/20 = 100% → ID = 50

C ARRAY ID : 21/20 = 105% → ID = 55

M ARRAY ID : 18/20 = 90% → ID = 40

Y ARRAY ID : 21/20 = 105% → ID = 55

FIG. 12

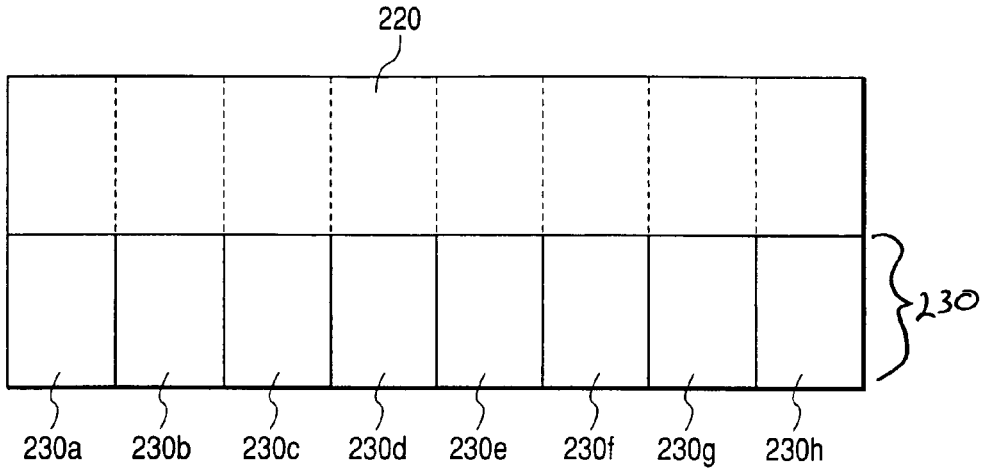

FIG. 13

| | COEFFICIENT FOR COLOR ADJUST VALUE (CYAN) | COEFFICIENT FOR COLOR ADJUST VALUE (MAGENTA) | COEFFICIENT FOR COLOR ADJUST VALUE (YELLOW) |
|---|---|---|---|
| CORRECTION COEFFICIENT GROUP a | 1.10 | 0.90 | 1.00 |
| CORRECTION COEFFICIENT GROUP b | 1.05 | 0.95 | 1.00 |
| CORRECTION COEFFICIENT GROUP c | 1.00 | 0.95 | 1.05 |
| CORRECTION COEFFICIENT GROUP d | 1.00 | 0.90 | 1.10 |
| CORRECTION COEFFICIENT GROUP e | 0.90 | 1.00 | 1.10 |
| CORRECTION COEFFICIENT GROUP f | 0.95 | 1.00 | 1.05 |
| CORRECTION COEFFICIENT GROUP g | 1.05 | 1.00 | 0.95 |
| CORRECTION COEFFICIENT GROUP h | 1.10 | 1.00 | 0.90 |
| CORRECTION COEFFICIENT GROUP i | 1.00 | 1.10 | 0.90 |
| CORRECTION COEFFICIENT GROUP j | 1.00 | 1.05 | 0.95 |
| CORRECTION COEFFICIENT GROUP k | 0.95 | 1.05 | 1.00 |
| CORRECTION COEFFICIENT GROUP l | 0.90 | 1.10 | 1.00 |

| BI-DIRECTIONAL ADJUSTMENT VALUE | L* | a* | b* | ΔE |
|---|---|---|---|---|
| -114.4 | 46.85 | -1.18 | -13.34 | 1.19 |
| -96.8 | 46.68 | -1.30 | -13.04 | 1.03 |
| -79.2 | 46.65 | -1.28 | -12.76 | 1.03 |
| -61.6 | 46.53 | -1.25 | -13.18 | 1.19 |
| -44 | 46.55 | -1.07 | -13.47 | 1.44 |
| -26.4 | 46.58 | -0.92 | -14.10 | 1.92 |
| -8.8 | 46.57 | -0.48 | -14.57 | 2.55 |
| 8.8 | 46.80 | -0.56 | -14.61 | 2.48 |
| | | | | |
| REFERENCE VALUE | 47.16 | -2.17 | -12.76 | |

LIQUID EJECTION APPARATUS WITH BI-DIRECTIONAL MOTION AND TONE MATCHING

BACKGROUND OF THE INVENTION

The present invention relates to a liquid ejection apparatus for ejecting liquid droplets from nozzle orifices, and particularly relates to a liquid ejection apparatus for ejecting liquid droplets from a plurality of nozzle orifices during each of reciprocating motions thereof.

In an ink jet recording apparatus (kind of the liquid ejection apparatus) such as an ink jet printer or an ink jet plotter, a recording head (head member) is moved in a primary scanning direction while recording paper (kind of liquid-ejected medium) is moved in a secondary scanning direction. In connection with such motions, ink droplets are ejected from nozzle orifices of the recording head so as to record an image (including characters and so on) on the recording paper. The ejection of ink droplets is performed, for example, by expansion and contraction of pressure generating chambers communicating with the nozzle orifices.

The expansion and contraction of the pressure generating chambers are performed, for example, by use of deformation of piezoelectric vibrators. In such a recording head, each piezoelectric vibrator is deformed in response to a driving pulse supplied thereto so that the volume of its corresponding pressure chamber is varied. In response to the volume change, there occurs a change of pressure in ink in the pressure chamber. Thus, an ink droplet is ejected from the nozzle orifice communicating with the pressure chamber.

In such a recording apparatus, a drive signal having a plurality of pulse waveforms connected in series is generated. On the other hand, print data SI including gradation information is transmitted to the recording head. Then, in accordance with the transmitted print data SI, only required pulse waveforms are selected from the drive signal and supplied to the piezoelectric vibrator. Thus, the quantity of an ink droplet to be ejected from the nozzle orifice is changed in accordance with the gradation information.

More specifically, for example, in a printer in which four gradations of non-recording print data (gradation information 00), small-dot print data (gradation information 01), middle-dot print data (gradation information 10) and large-dot print data (gradation information 11) are set, ink droplets different in ink volume are ejected in accordance with the gradation levels respectively.

In order to attain four-gradation recording as described above, for example, a drive signal PA as shown in FIG. 21 can be used. This drive signal PA is a pulse train waveform signal in which a first pulse signal PAPS1 disposed in a period PAT1 and a second pulse signal PAPS2 disposed in a period PAT2 are connected in series and which is generated repetitively with a recording period PATA.

In the drive signal PA, the first pulse signal PAPS1 is a small-dot driving pulse for ejecting a small ink droplet from a nozzle orifice, and the second pulse signal PAPS2 is a middle-dot driving pulse for ejecting a middle ink droplet from a nozzle orifice.

In this case, as shown in FIG. 22, recording corresponding to the large dot can be performed by supplying a combination of the first pulse signal PAPS1 and the second pulse signal PAPS2.

In order to perform recording on recording paper at a higher speed, it is preferable that ink droplets are ejected from the nozzle orifices of the recording head to thereby record an image (including characters and so on) on the recording paper in each of forward travel and backward travel of reciprocating motion of the recording head in the primary scanning direction. That is, it is preferable that after recording one line during forward motion, the recording head moves by line width (including interline width) in the secondary scanning direction relatively to the recording paper, and records the next line during backward motion (in an opposite direction). The ink jet recording apparatus capable of recording in each of forward and backward motions is called a bi-directional (Bi-D) type.

In order to improve the recording accuracy in the bi-directional type ink jet recording apparatus, it is known that the waveform of a forward drive signal is preferably made different from the waveform of a backward drive signal. Generation of such waveforms of drive signals is described in detail in Japanese Patent Publication No. 2000-1001A.

An example will be described with reference to FIGS. 23A and 23B. A forward drive signal PA is a periodic signal of a first pulse train P1 having a first pulse waveform w1 and a second pulse waveform w2 in that order.

Here, the first pulse waveform w1 and the second pulse waveform w2 correspond to the first pulse signal PAPS1 and the second pulse signal PAPS2 in FIG. 21 respectively. That is, the first pulse waveform w1 (first pulse signal PAPS1) is a pulse waveform for ejecting a small-dot liquid droplet, and the second pulse waveform w2 (second pulse signal PAPS1) is a pulse waveform for ejecting a middle-dot liquid droplet.

Then, two-bit pulse selection data is generated in accordance with gradation data per recording pixel during forward motion. In this case, pulse selection data (10) for selecting only the first pulse waveform w1 is generated in accordance with gradation data corresponding to a small dot; pulse selection data (01) for selecting only the second pulse waveform w2 is generated in accordance with gradation data corresponding to a middle dot; and pulse selection data (11) for selecting both the first pulse waveform w1 and the second pulse waveform w2 is generated in accordance with gradation data corresponding to a large dot.

On the other hand, a backward drive signal PB is a periodic signal of a second pulse train P2 having a second pulse waveform w2 and a first pulse waveform w1 in that order. Here, the second pulse waveform w2 and the first pulse waveform w1 are similar to those of the forward drive signal PA.

Then, two-bit pulse selection data is generated in accordance with gradation data per recording pixel during backward motion. In this case, pulse selection data (01) for selecting only the first pulse waveform w1 is generated in accordance with gradation data corresponding to a small dot; pulse selection data (10) for selecting only the second pulse waveform w2 is generated in accordance with gradation data corresponding to a middle dot; and pulse selection data (11) for selecting both the first pulse waveform w1 and the second pulse waveform w2 is generated in accordance with gradation data corresponding to a large dot.

In such a manner, the order of the pulse waveforms belonging to the forward drive signal is made reverse to the order of the pulse waveforms belonging to the backward drive signal. Thus, as shown in FIG. 24, the positions (in the primary scanning direction) where ejected ink droplets are landed can be aligned in the secondary scanning direction.

In addition, each ink droplet ejected during the forward motion has an initial velocity in which a forward velocity component of the recording head is added to the ink droplet's own initial velocity from the recording head toward the recording paper. Therefore, the point where the ejected ink droplet is landed actually on the recording paper is shifted in the forward direction. On the contrary, each ink droplet ejected during the backward motion has an initial velocity in which a backward velocity component of the recording head is added to the ink droplet's own initial velocity from the recording head toward the recording paper. Therefore, the point where the ejected ink droplet is landed actually on the recording paper is shifted in the backward direction. Thus, in order to secure continuity between a subject (for example, an image) to be recorded during the forward motion and a subject to be recorded during the backward motion, adjustment is made such that the timing with which the backward drive signal is supplied is evenly shifted from the timing with which the forward drive signal is supplied. This shift quantity is called a Bi-D adjustment value.

Determination of the Bi-D adjustment value (timing adjustment value) is made by printing a vertical ruled line during forward motion and backward motion following the forward motion to thereby verify continuity, or printing a patch pattern during forward motion and backward motion following the forward motion to thereby examine the presence/absence of a sense of surface roughness.

On the other hand, in a recording head for color printing, a plurality of arrays of nozzle orifices for ejecting a plurality of color inks respectively are provided in parallel. Desired color recording can be obtained by ejecting the respective colors of ink suitably on top of one another. The plurality of color inks are, for example, black ink, cyan ink, magenta ink, and yellow ink.

Generally, in bi-directional type color ink jet recording apparatus, a Bi-D adjustment value for the black ink and a Bi-D adjustment value for the other color inks are adjusted independently.

However, in order to attain higher-quality color printing, the bi-directional type color ink jet recording apparatus as described above has the following problems.

For example, assume that in a recording head for color printing, an array of nozzle orifices for ejecting cyan ink (C), an array of nozzle orifices for ejecting magenta ink (M) and an array of nozzle orifices for ejecting yellow ink (Y) are provided in parallel in that order, and recording is carried out with the cyan ink (C), the magenta ink (M) and the yellow ink (Y) in that order during the forward motion of the recording head. In this case, during the backward motion of the recording head, recording is made with the yellow ink (Y), the magenta ink (M) and the cyan ink (C) in that order.

Here, consideration is given to gray color formed in a three-color composite of the cyan ink (C), the magenta ink (M) and the yellow ink (Y). In the forward motion of the recording head, the cyan ink (C), the gray color is formed by superimposition of the magenta ink (M) and the yellow ink (Y) on one another in that order. On the contrary, in the backward motion of the recording head, the gray color is formed by superimposition of the yellow ink (Y), the magenta ink (M) and the cyan ink (C) on one another in that order.

It is known that one and the same combination of inks may produce different tones due to a difference in the order in which the ink droplets are landed, as described the above. A variation (shift) of a tone caused by the order in which inks are landed is the most conspicuous in gray color, particularly a halftone gray color.

In the case of pigment inks, it is considered that the color of the ink landed last is dominant because the inks are generally high in light blocking effect (apt to hide the background color). For example, it can be considered that when the ink landed last is a yellow ink, the tone is tinged with the yellow.

In the case of dye ink, the problem caused by the light blocking effect of the ink is indeed not significant, but a subsequent ink landing on a precedent ink may "spread". Thus, the color of the ink landed first is rather dominant.

For this reason, there is a problem of a color difference formed like horizontal stripes (kind of so-called banding) within a sheet of recording subject due to a difference in recording direction during printing. In addition, there is another problem that the tone of a print obtained by bi-directional printing differs from the tone of a print obtained by unidirectional printing in spite of one and the same image data.

Generally in the ink jet recording apparatus, a plurality of kinds of recording paper can be used. The thickness may be not even among those kinds of recording paper. In addition, some recording apparatus can change the distance between the recording head and the recording paper. Further, the distance between the recording head and the recording paper fluctuates due to an error in assembling the recording apparatus.

For example, in a recording head for color printing, assume that an array of nozzle orifices for ejecting cyan ink (C), an array of nozzle orifices for ejecting magenta ink (M) and an array of nozzle orifices for ejecting yellow ink (Y) are provided in parallel in that order, and recording is carried out with the cyan ink (C), the magenta ink (M) and the yellow ink (Y) in that order during the motion of the recording head. In this case, recording is carried out with the yellow ink (Y), the magenta ink (M) and the cyan ink (C) in that order during the motion of the recording head.

Here, each color ink is ejected from each nozzle orifice onto the recording paper. When the distance between each nozzle orifice and the recording paper is not enough large, a so-called main droplet and a so-called satellite droplet are landed in a state in which the main and satellite droplets are not separated thoroughly but overlap each other.

The tone may change due to overlapping of the ink droplets of one and the same color, which droplets should be separated.

When ink droplets of the cyan ink (C) or the magenta ink (M) are superimposed on each other, the value of optical density linearly increases. In other words, in those colors of ink, a linear relation is established between the number of superimposed ink droplets and the increased value of optical density.

However, in the yellow ink (Y), a linear relation is not established between the number of superimposed ink droplets and the increased value of optical density, but the growth of the value of optical density rapidly saturated. As a result, the increase (growth) of the value of optical density of the yellow ink (Y) due to superimposed ink droplets is smaller than that of any other color ink. This phenomenon can be regarded as caused by the yellow color material ratio in the ink which ratio is higher than any other color material ratio because the coloring of the yellow color material is the weakest.

In such a manner, there is a difference in properties among the ink colors when ink droplets are superimposed on each other. This difference appears as a change of tone when the distance between each nozzle orifice and recording paper is not enough large.

FIG. 25 shows a specific example. In this case, when the distance (PG: Paper Gap) between each nozzle orifice and recording paper is not larger than 1.06 mm, a main droplet overlaps a satellite droplet so that a hue difference ΔE increases.

SUMMARY OF THE INVENTION

It is an object of the invention to provide liquid ejection apparatus, particularly bi-directional type ink jet recording apparatus, in which the tone of a recording subject recorded during forward motion can be matched with the tone of the recording subject recorded during backward motion.

It is also an object of the invention to provide liquid ejection apparatus, particularly bi-directional type ink jet recording apparatus, in which the relative quantity ratio of each liquid ejected from each nozzle orifice is adjusted in accordance with the distance between the nozzle orifice and a recording medium so that, for example, the tone can be adjusted.

In order to attain the foregoing objects, according to the invention, there is provided a liquid ejection apparatus, comprising:

a head member, provided with nozzles including a plurality of nozzle groups each associated with one of a plurality of colors of liquid;

a plurality of pressure fluctuation generator, each of which is operable to generate pressure fluctuation in liquid in each of the nozzles to eject a liquid droplet therefrom;

a carriage, operable to carry the head member so as to reciprocately transverse a first region in which a medium, on which the liquid droplet is landed, is placed;

a signal generator, operable to generate a first signal and a second signal;

a controller, operable to drive the pressure fluctuation generator according to the first signal and ejection pattern data in a case where the head member transverse the first region in a first direction, and to drive the pressure fluctuation generator according to the second signal and the ejection pattern data in a case where the head member transverse the first region in a second direction opposite to the first direction; and a pattern data adjuster, operable to adjust the ejection pattern data so as to vary an ejected number of the liquid droplet per a unit area, for each of the nozzle groups.

Preferably, the pattern data adjuster adjusts the ejection pattern data so as to vary relative percentages among liquid droplets of the respective colors in all liquid droplets ejected in the unit area.

In such a configuration, the tone of an image formed during forward motion can be matched with the tone of an image formed during backward motion with high accuracy.

In general, the first signal and the second signal are different from each other. However, the first signal and the second signal may be identical with each other.

Preferably, the liquid ejection apparatus further comprises a tone confirmation controller, operable to control the pattern data adjuster, the controller and the carriage such that: at least one first liquid mixing portion, at which liquid droplets of the plural colors are superposed, is formed on the medium when the head member transverses the first region in the first direction; and a plurality of second liquid mixing portions, at which liquid droplets of the plural colors are superposed while varying the ejected number of the liquid droplet per the unit area, are formed on the medium when the head member transverse the first region in the second direction. The at least one first liquid mixing portion and the second liquid mixing portions are arranged on the medium in a comparative manner.

In this case, when the first liquid mixing portion is contrasted with the plurality of second liquid mixing portions, one of the second liquid mixing portions the most conformable to the tone of the first liquid mixing portion can be selected. Then, when the number of times of ejecting each color liquid per unit area corresponding to the selected second liquid mixing portion is set as the number of times of ejecting each color liquid per unit area to be adjusted, the tone of an image formed during forward motion can be matched with the tone of an image formed during backward motion with high accuracy.

Here it is preferable that a plurality of first liquid mixing portions are formed. In this case, the plurality of first liquid mixing portions can be contrasted with the plurality of second liquid mixing portions. Accordingly, one of the second liquid mixing portions the most conformable to the first liquid mixing portion can be selected more easily. The first liquid mixing portions may be formed by superposing liquid droplets of the plural colors while varying the ejected number of the liquid droplet per the unit area, when the head member transverses the first region in the first direction.

It is further preferable that: the medium is placed in the first region movably in a third direction perpendicular to the first direction and the second direction; the second liquid mixing portions are arranged in the second direction; and the first liquid mixing portion and the second liquid mixing portions are adjacent in the third direction. In this case, the easiness of selection is enhanced.

Here, there may be configured that: the medium is placed in the first region movably in a third direction perpendicular to the first direction and the second direction; the second liquid mixing portions are arranged in the third direction; and the first liquid mixing portion and the second liquid mixing portions are adjacent in the second direction.

Preferably, the nozzle groups are at least three groups respectively associated with cyan liquid, magenta liquid and yellow liquid. In this case, each of the first liquid mixing portion and the second liquid mixing portions is a gray color pattern formed out of liquid of cyan color, liquid of magenta color and liquid of yellow color. The gray color pattern is suitable as a subject of tone confirmation because a tone (hue) shift appears conspicuously therein. Particularly it is preferable that each of the first liquid mixing portion and the second liquid mixing portions is a halftone gray color solid pattern.

Preferably, the unit area includes a matrix pattern constituted by a plurality of pixels each of which is associated with one liquid droplet. For example, a matrix measuring 16 by 16 may be set as a unit area. This is a matrix pattern called "dither".

Alternatively, a size of the unit area is variable according to the ejection pattern data. Particularly, a fixed pattern such as "dither" may be inappropriate for some printing jobs of natural images or the like. In such a case, it is preferable that a variable pattern is used as a unit area for each portion of each image in consideration of "error diffusion".

According to the invention, there is also provided a method of adjusting the ejected number of the liquid droplet per the unit area, performed in the above liquid ejection apparatus, comprising steps of:

forming at least one first liquid mixing portion, at which liquid droplets of the plural colors are superposed, on the medium when the head member transverses the first region in the first direction;

forming a plurality of second liquid mixing portions, at which liquid droplets of the plural colors are superposed while varying the ejected number of the liquid droplet per the unit area, on the medium when the head member transverse the first region in the second direction;

comparing the second liquid mixing portions with the first liquid mixing portion to select one of the second liquid mixing portions having a tone closest to a tone of the first liquid mixing portion; and adjusting the ejection pattern data so as to correspond to an ejected number of the liquid droplet per the unit area which is associated with the selected one of the second liquid mixing portions.

Here, the comparing step is performed with operator's eyes or a colorimetry device.

Preferably, the adjusting method further comprises steps of:

forming a plurality of third liquid mixing portions, at which liquid droplets of the plural colors are superposed while varying the ejected number of the liquid droplet per the unit area, on the medium when the head member transverses the first region in the first direction;

comparing the third liquid mixing portions with the first liquid mixing portion to select one of the second liquid mixing portions having a tone closest to a tone of the first liquid mixing portion; and adjusting the ejection pattern data so as to correspond to an ejected number of the liquid droplet per the unit area which is associated with the selected one of the third liquid mixing portions.

According to the invention, there is also provided a liquid ejection apparatus, comprising:

a head member, comprising a nozzle face formed with nozzles;

a plurality of pressure fluctuation generator, each of which is operable to generate pressure fluctuation in liquid in each of the nozzles to eject a liquid droplet therefrom;

a carriage, operable to carry the head member so as to transverse a first region in which a medium, on which the liquid droplet is landed, is placed;

a controller, operable to drive the pressure fluctuation generator according to ejection pattern data in a case where the head member transverse the first region;

a distance detector, operable to detect a distance between the nozzle face and the medium and a pattern data adjuster, operable to adjust the ejection pattern data so as to vary an ejected number of the liquid droplet per a unit area, in accordance with the distance.

In such a configuration, the number of times of ejecting the liquid from each nozzle orifice per unit area can be adjusted on the basis of the distance detected by the distance detector. Thus, the change in landing properties caused by overlapping of a main droplet and a satellite droplet of each liquid when the main and satellite droplets are landed can be compensated suitably.

Preferably, the nozzles includes a plurality of nozzle groups each associated with one of a plurality of colors of liquid; and the pattern data adjuster adjust the ejection pattern data for each of the nozzle groups.

In this case, a change in tone caused by overlapping of a main droplet and a satellite droplet of each liquid when the main and satellite droplets are landed can be compensated suitably.

Here, it is preferable that the nozzle groups are at least three groups respectively associated with cyan liquid, magenta liquid and yellow liquid.

Preferably, the distance is detected based on a thickness of the medium and a distance between the nozzle face and a surface in the first region on which the medium is placed.

Preferably, the liquid ejection apparatus further comprises a gap adjuster, operable to vary the distance, and to acquire information regarding the distance.

Preferably, the liquid ejection apparatus further comprises a storage, operable to store a variation rate of the ejected number in association with the distance.

Here, it is preferable that the variation rate is at least two-bit data representing whether the distance is enough to separate the liquid droplet into a main droplet and a satellite droplet.

It is also preferable that the variation rate and the distance are associated with a table.

Preferably, the unit area includes a matrix pattern constituted by a plurality of pixels each of which is associated with one liquid droplet. For example, a matrix measuring 16 by 16 may be set as a unit area. This is a matrix pattern called "dither".

Alternatively, a size of the unit area is variable according to the ejection pattern data. Particularly, a fixed pattern such as "dither" may be inappropriate for some printing jobs of natural images or the like. In such a case, it is preferable that a variable pattern is used as a unit area for each portion of each image in consideration of "error diffusion".

According to the invention, there is also provided an apparatus for controlling a liquid ejection apparatus, which comprises:

a head member, provided with nozzles including a plurality of nozzle groups each associated with one of a plurality of colors of liquid;

a plurality of pressure fluctuation generator, each of which is operable to generate pressure fluctuation in liquid in each of the nozzles to eject a liquid droplet therefrom; and a carriage, operable to carry the head member so as to reciprocately transverse a first region in which a medium, on which the liquid droplet is landed, is placed, the controlling apparatus comprising:

a signal generator, operable to generate a first signal and a second signal;

a controller, operable to drive the pressure fluctuation generator according to the first signal and ejection pattern data in a case where the head member transverse the first region in a first direction, and to drive the pressure fluctuation generator according to the second signal and the ejection pattern data in a case where the head member transverse the first region in a second direction opposite to the first direction; and a pattern data adjuster, operable to adjust the ejection pattern data so as to vary an ejected number of the liquid droplet per a unit area, for each of the nozzle groups.

According to the invention, there is also provided an apparatus for controlling a liquid ejection apparatus which comprises:

a head member, comprising a nozzle face formed with nozzles;

a plurality of pressure fluctuation generator, each of which is operable to generate pressure fluctuation in liquid in each of the nozzles to eject a liquid droplet therefrom; and a carriage, operable to carry the head member so as to transverse a first region in which a medium, on which the liquid droplet is landed, is placed, the controlling apparatus comprising:

a controller, operable to drive the pressure fluctuation generator according to ejection pattern data in a case where the head member transverse the first region;

a distance detector, operable to detect a distance between the nozzle face and the medium and a pattern data adjuster, operable to adjust the ejection pattern data so as to vary an ejected number of the liquid droplet per a unit area, in accordance with the distance.

The control apparatus or the respective elements therein may be implemented by a computer system.

In addition, the invention also includes a program for making the computer system to implement the respective elements of the apparatus, and a computer-readable recording medium recording the program.

Here, the recording medium includes a network propagating various signals, as well as a medium that can be recognized as a unit such as a floppy disk.

Incidentally, the number of nozzles belonging to one nozzle group is optional, and it may be one.

BRIEF DESCRIPTION OF THE DRAWINGS

The accompanying drawings include:

FIG. 10 is an example of an assignment table of color adjust IDs to ink weight ratios;

FIG. 11 is a table showing a specific example of a color adjust ID set on the basis of the weight of an ink droplet ejected from each nozzle array;

FIG. 12 is a diagram showing an example of a formation pattern of a forward-scanning liquid mixing portion and backward-scanning mixture patches;

FIG. 13 is a table showing an example of correction coefficient sets for color adjust values;

DETAILED DESCRIPTION OF THE INVENTION

Preferred embodiments of the invention will be described below with reference to the accompanying drawings.

Figure 1:
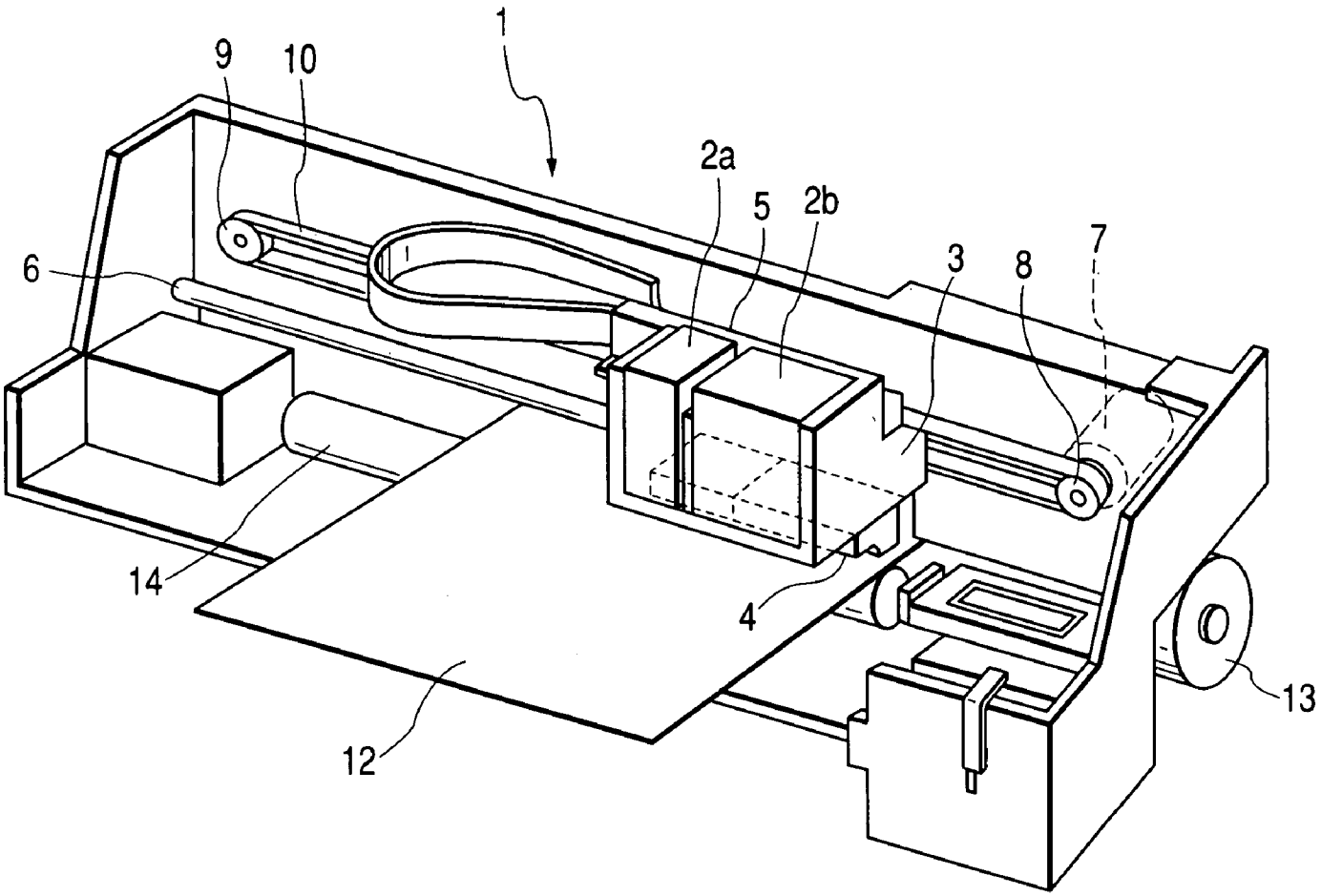
FIG. 1 is a schematic perspective view of ink jet recording apparatus according to a first embodiment of the invention.

An ink jet printer 1 (liquid ejection apparatus) according to a first embodiment of the invention as shown in FIG. 1 has a carriage 5 including a cartridge holder 3 and a recording head 4. The cartridge holder 3 can hold a black ink cartridge 2*a* and a color ink cartridge 2*b*. The carriage 5 is reciprocated in a primary scanning direction by a head scanning mechanism.

The head scanning mechanism is constituted by a guide member 6 extending in the lateral direction of a housing, a pulse motor 7 provided on one side of the housing, a driving pulley 8 connected to a rotating shaft of the pulse motor 7 to be thereby driven and rotated, an idling pulley 9 attached to the other side of the housing, a timing belt 10 laid between the driving pulley 8 and the idling pulley 9 and coupled with the carriage 5, and a controller 11 (see FIG. 6) for controlling the rotation of the pulse motor 7. Thus, by actuating the pulse motor 7, the carriage 5, that is, the recording head 4 can be reciprocated in the primary scanning direction corresponding to the width direction of recording paper 12.

In addition, the printer 1 has a paper feed mechanism (liquid-ejected medium holder) for feeding a recording medium (liquid-ejected medium) such as recording paper 12 in a paper feed direction (secondary scanning direction). The paper feed mechanism is constituted by a paper feeding motor 13, a paper feed roller 14, and so on. Recording media such as the recording paper 12 are fed out in turn interlocking with the recording operation.

The head scanning mechanism and the paper feed mechanism according to this embodiment are designed to be able to support the recording paper 12 of a large size such as B0. In addition, the printer 1 in this embodiment carries out the recording operation only during the forward motion of the recording head 4 or during both the forward motion and the backward motion of the recording head 4 (capable of bi-directional recording).

In addition, the recording operation includes a mode ("fast mode"; one-pass printing) in which recording of each area is completed by one-time forward or backward scanning of the recording head, and a mode ("fine mode"; multi-pass printing) in which recording of each area is completed by multiple-time scanning. Both dots recorded during forward motion and during backward motion are mixed in each area at the time of the bi-directional recording of multi-pass printing.

Figure 2A:
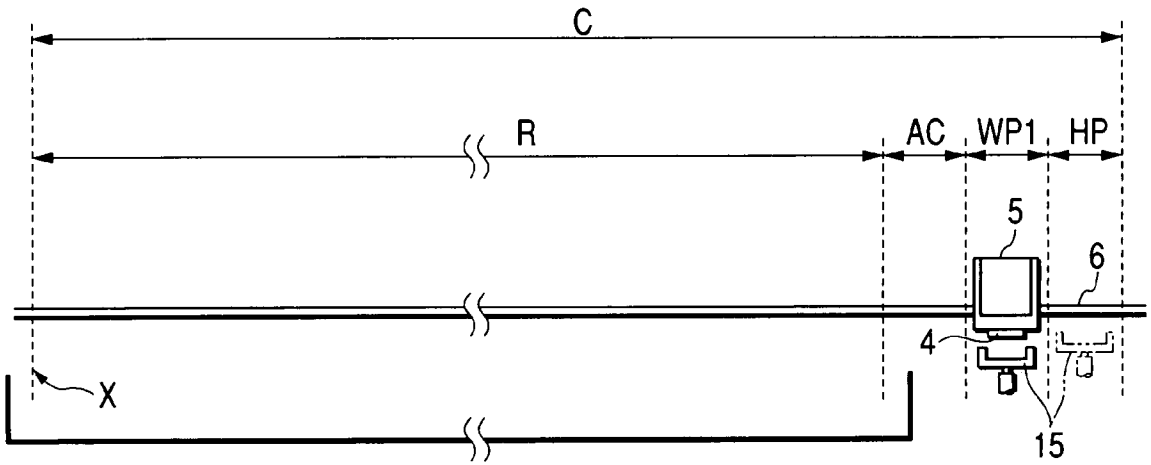
FIG. 2A is a schematic view for explaining a scanning range of a recording head in ink jet recording apparatus performing unidirectional recording.

A home position HP and a waiting position WP of the recording head 4 (carriage 5) are established within a moving range C of the carriage 5 and in an end portion area outside a recording area R. As shown in FIG. 2A, the home position HP is set in a one-side end portion (right side in the figure) of the head moving range where the recording head 4 can move. On the other hand, the waiting position WP is set to be adjacent to the home position HP on the recording area R side.

Figure 2B:
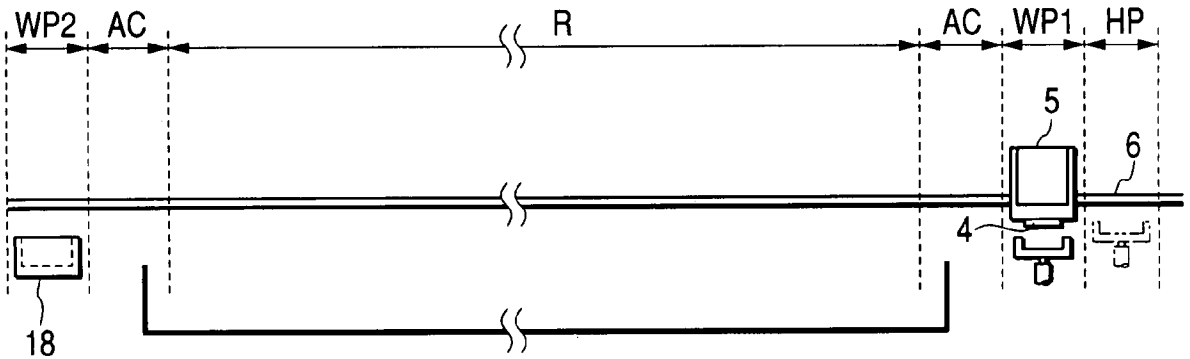
FIG. 2B is a schematic view for explaining a scanning range of a recording head in ink jet recording apparatus performing bi-directional recording.

When the printer can carry out bi-directional recording, a second waiting position WP2 can be provided in the end portion opposite to the home position HP in addition to a first waiting position WP1 adjacent to the home position HP as shown in FIG. 2B.

Figure 3A:
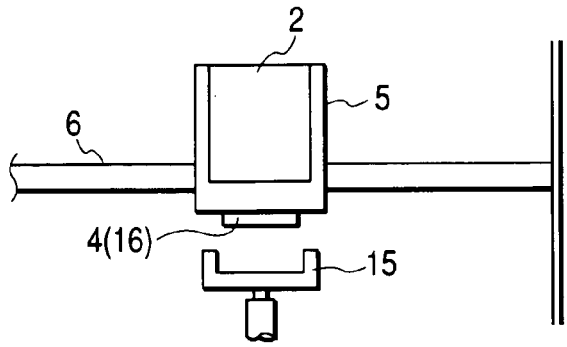
FIG. 3A is a schematic view showing a recording head located in a waiting position.
Figure 3B:
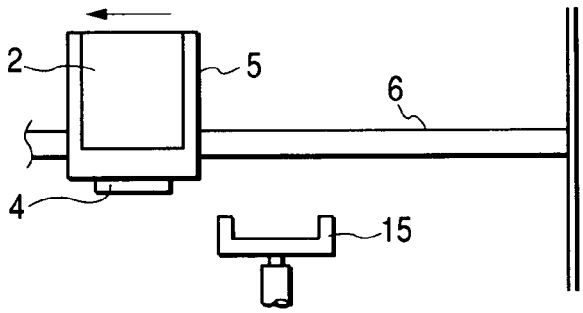
FIG. 3B is a schematic view showing the state where the recording head is moving from the waiting position to the recording area side.
Figure 3C:
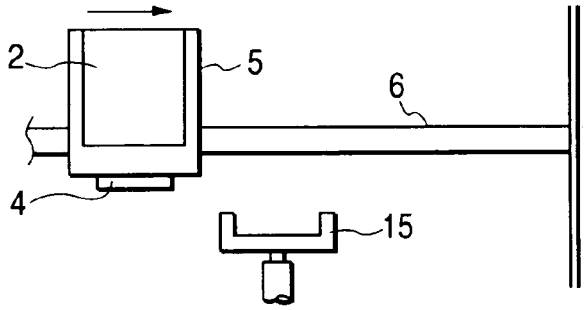
FIG. 3C is a schematic view showing the state where the recording head is moving from the recording area side to the waiting position.
Figure 3D:
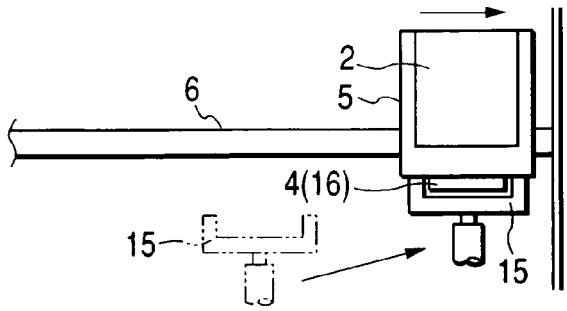
FIG. 3D is a schematic view showing the state where the recording head is located in a home position.

The home position HP is a site where the recording head 4 moves and stays when the power is off or when recording has not been carried out for a long time. When the recording head 4 is located in the home position HP, a cap member 15 of a capping mechanism abuts against a nozzle plate 16 (see FIG. 4) so as to seal off nozzle orifices 17 (see FIG. 4), as shown in FIG. 3D. The cap member 15 is a member molded out of an elastic member such as rubber so as to be formed into a substantially quadrangular tray-like shape whose top is open. A moisture retaining material such as felt is attached to the inside of the cap member 15. When the recording head 4 is sealed off by the cap member 15, high moisture is retained inside the cap so that evaporation of an ink solvent from the nozzle orifices 17 is tempered.

The waiting position WP is a position to be used as a start point when the recording head 4 carries out scanning. That is, the recording head 4 usually stands ready in the waiting position WP, and is moved from the waiting position WP to the recording area R side at the time of recording operation as shown in FIG. 3B. When the recording operation is terminated, the recording head 4 returns to the waiting position WP as shown in FIG. 3C.

When the printer performs bi-directional recording, the recording head 4 waiting in the first waiting position WP1 is moved toward the second waiting position WP2 so as to perform a forward recording operation, as shown in FIG. 2B. When the forward recording operation is terminated, the recording head 4 waits in the second waiting position WP2. Next, the recording head 4 waiting in the second waiting position WP2 is moved toward the first waiting position WP1 so as to perform a backward recording operation. When the backward recording operation is terminated, the recording head 4 waits in the first waiting position. After that, the forward recording operation and the backward recording operation are executed alternately and repetitively.

An ink receiver for recovering ink discharged by the recording head 4 in a flushing operation (kind of maintenance operation) is provided in the waiting position WP.

In this embodiment, the cap member 15 also has a function as the ink receiver. That is, the cap member 15 is usually disposed in a position under the waiting position WP of the recording head 4 (in a position under the nozzle plate 16 and at a small distance therefrom). Then, with the motion of the recording head 4 to the home position HP, the cap member 15 moves up obliquely (toward the home position and toward the nozzle plate 16) so as to seal off the nozzle orifices 17, as shown in FIG. 3D.

In the case of the printer carrying out bi-directional recording, an ink receiver 18 is also disposed in the second waiting position WP2, as shown in FIG. 2B. The ink receiver 18 can be, for example, formed out of a flushing box having a box-like shape open in the surface opposed to the recording head 4.

Further, in this embodiment, an acceleration area AC is set between the waiting position and the recording area. The acceleration area AC is an area where the scanning speed of the recording head 4 is accelerated to a predetermined speed.

Figure 4:
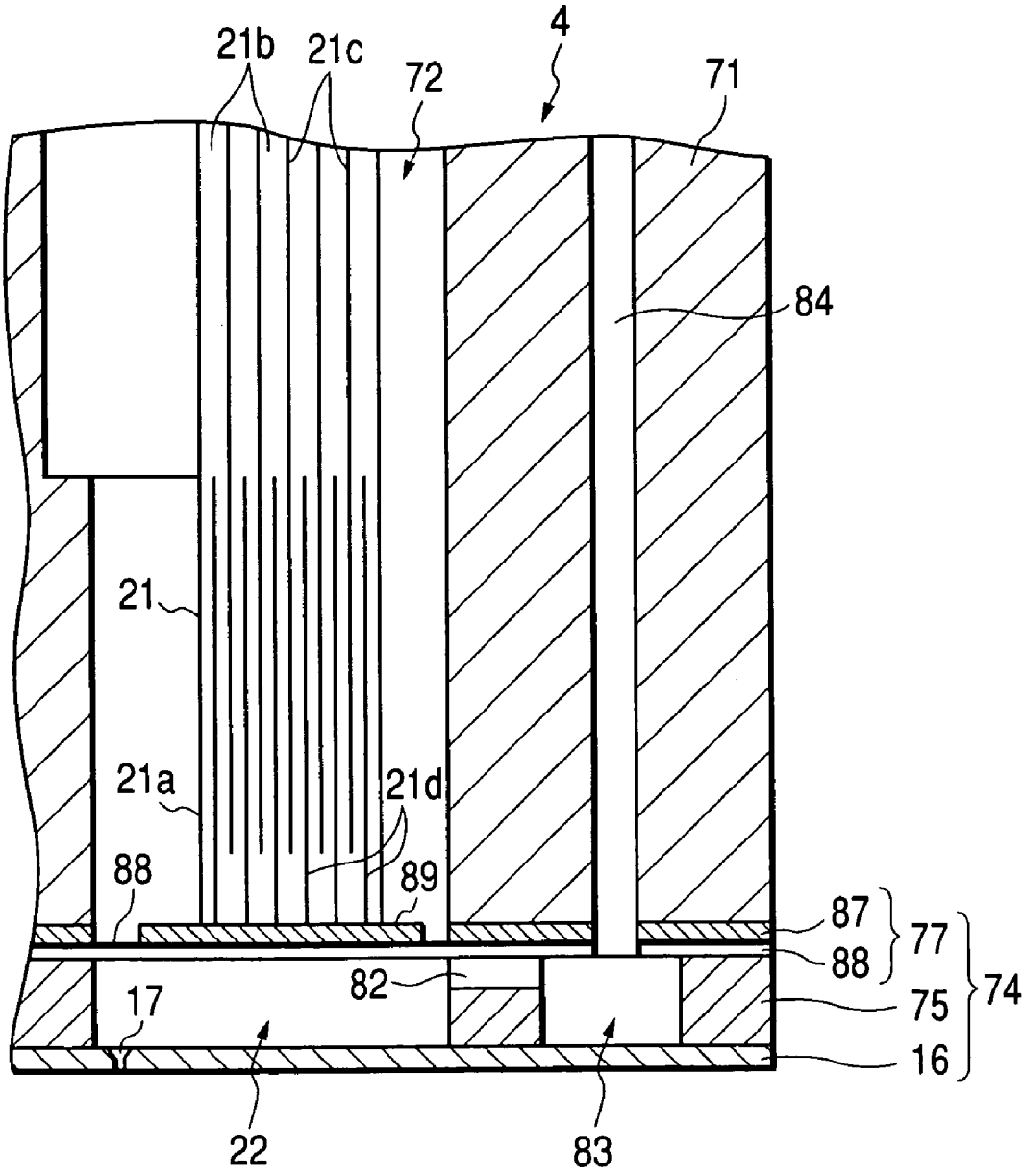
FIG. 4 is a sectional view for explaining the configuration of the recording head.

Next, description will be made on the recording head 4. As shown in FIG. 4, in the recording head 4, pectinated piezoelectric vibrators 21 (pressure actuator) are inserted into a reception chamber 72 of a box-shaped casing 71 made of plastic etc., from one opening of the reception chamber 72, so that pectinated tip portions 21*a* face the other opening of the reception chamber 72. A flow passage unit 74 is connected to the surface (lower surface) of the casing 71 on the other opening side so that the pectinated tip portions 21*a* are fixed in contact with predetermined portions of the flow passage unit 74 respectively.

The piezoelectric vibrators 21 are formed by cutting a sheet-shaped diaphragm into a pectinated shape corresponding to the dot formation density. In the vibrator plate, common internal electrodes 21*c* and individual internal electrodes 21*d* are laminated alternately through piezoelectric pieces 21*b*. Then, when a potential difference is applied between the common internal electrodes 21*c* and the individual internal electrodes 21*d*, the piezoelectric vibrators 21 expand and contract in the vibrator longitudinal direction perpendicular to the lamination direction respectively.

The flow passage unit 74 is constituted by the nozzle plate 16 and an elastic plate 77 laminated on the opposite sides with a flow passage formation plate 75 sandwiched between the nozzle plate 16 and the elastic plate 77.

The flow passage formation plate 75 is a plate member in which a plurality of pressure generating chambers 22, a plurality of ink supply ports 82 and an elongated common ink chamber 83 are formed. The pressure generating chambers 22 are arrayed and separated by partition walls so as to communicate with a plurality of nozzle orifices 17 provided in the nozzle plate 16, respectively. The ink supply ports 82 communicate with at least one-side ends of the pressure generating chambers 22 respectively. All the ink supply ports 82 communicate with the common ink chamber 83. For example, etching may be performed on a silicon wafer to form the long common ink chamber 83, form the pressure generating chambers 22 in the longitudinal direction of the common ink chamber 83 in accordance with the pitch of the nozzle orifices 17, and form the groove-like ink supply ports 82 between the pressure generating chambers 22 and the common ink chamber 83 respectively. Incidentally, arrangement is made so that the ink supply ports 82 are connected to one-side ends of the pressure generating chambers 22 while the nozzle orifices 17 are located near the other end portions opposite to the ink supply ports 82. In addition, the common ink chamber 83 is a chamber from which ink reserved in an ink cartridge is supplied to the pressure generating chambers 22. An ink supply tube 84 communicates with the common ink chamber 83 substantially at the longitudinal center of the common ink chamber 83.

The elastic plate 77 is laminated to the surface of the flow passage formation plate 75 opposite to the nozzle plate 16. The elastic plate 77 has a double-layer structure in which a polymer film of PPS or the like is laminated as an elastic film 88 to the lower surface of a stainless steel plate 87. Then, the stainless steel plate 87 is etched correspondingly to the pressure generating chambers 22, so as to form an island portion 89 for fixing the piezoelectric vibrators 21 in contact therewith.

In the recording head 4 configured thus, when the piezoelectric vibrator 21 is expanded in the longitudinal direction thereof, the island portion 89 is pressed toward the nozzle plate 16 so that the elastic film 88 in the vicinity of the island portion 89 is deformed to contract the pressure generating chamber 22. On the contrary, when the piezoelectric vibrator 21 is contracted in the longitudinal direction thereof in the state where the pressure generating chamber 22 is contracted, the pressure generating chamber 22 is expanded by the elasticity of the elastic film 88. When the pressure generating chamber 22 expanded once is contracted, the ink pressure in the pressure generating chamber 22 is increased so that an ink droplet is ejected from the nozzle orifice 17.

That is, in the recording head 4, as the piezoelectric vibrator 21 is charged/discharged, the volume of the corresponding pressure chamber 22 changes. Using such a pressure change of the pressure chamber 22, an ink droplet can be ejected from the nozzle orifice 17, or a meniscus (free surface of ink exposed in the nozzle orifice 17) can be finely vibrated.

Incidentally, instead of the longitudinal vibration mode piezoelectric vibrator 21, a so-called flexural vibration mode piezoelectric vibrator may be used. The flexural vibration mode piezoelectric vibrator is a piezoelectric vibrator for contracting a pressure chamber due to deformation of the piezoelectric vibrator caused by charging and for expanding the pressure chamber due to deformation of the piezoelectric vibrator caused by discharging.

In this case, the recording head 4 is a multicolor recording head capable of recording in a plurality of different colors. The multicolor recording head has a plurality of head units, and the kind of ink to be used is set for each head unit.

Figure 5:
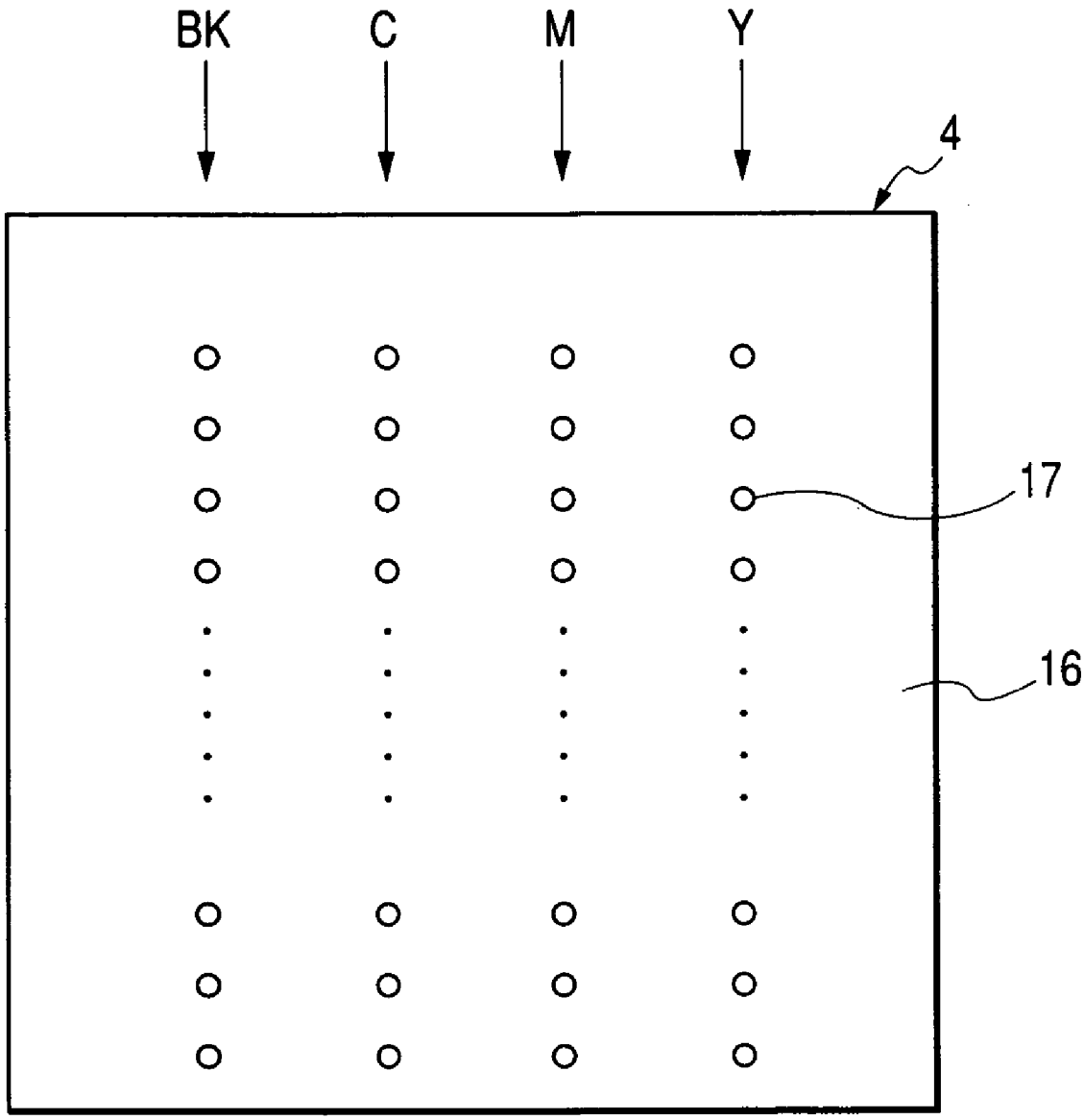
FIG. 5 is a plan view showing nozzle arrays corresponding to respective colors.

The recording head 4 in this embodiment has a black head unit capable of ejecting black ink, a cyan head unit capable of ejecting cyan ink, a magenta head unit capable of ejecting magenta ink and a yellow head unit capable of ejecting yellow ink. Each head unit communicates with an ink chamber of an associated ink cartridge 2*a*, 2*b*. Each head unit has a configuration described with reference to FIG. 4, and a nozzle array constituted by a plurality of nozzle orifices 17 is formed for each ink color (BK, C, M, Y) as shown in FIG. 5.

Here, mainly for the sake of manufacturing, the properties about ink droplet ejection of nozzle orifices 17 tend to be coincident with each other on the basis of each nozzle array.

Figure 6:
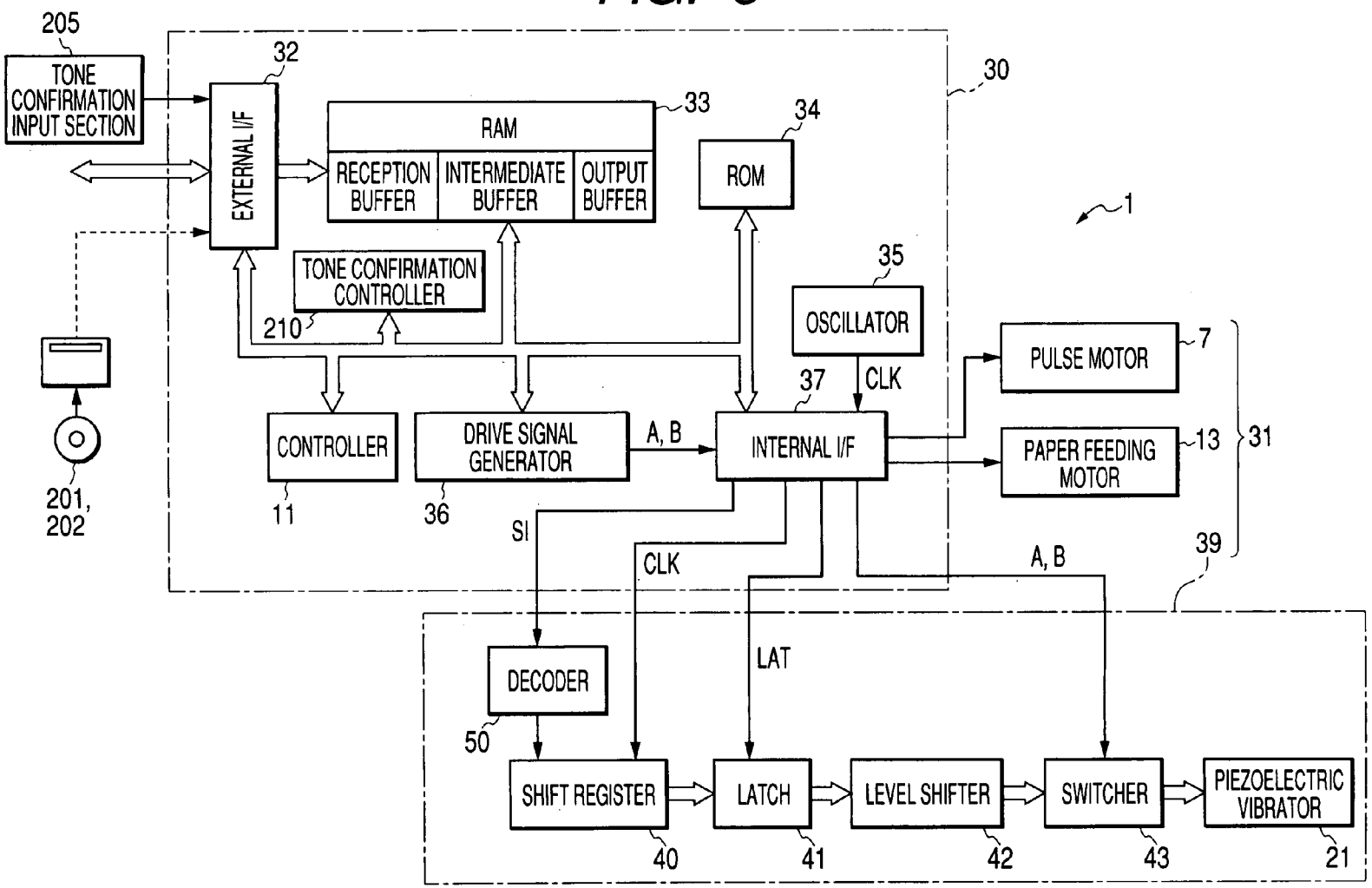
FIG. 6 is a schematic block diagram showing the electric configuration of the recording head according to the first embodiment.

Next, description will be made on the electric configuration of the printer 1. As shown in FIG. 6, the ink jet printer 1 has a printer controller 30 and a print engine 31.

The printer controller 30 has an external interface (external I/F) 32, a RAM 33 for storing various data temporarily, a ROM 34 for storing control programs and so on, a controller 11 designed to include a CPU and so on, an oscillator 35 for generating a clock signal CLK, a drive signal generator 36 for generating a drive signal and so on to be supplied to the recording head 4, and an internal interface (internal I/F) 37 for transmitting the drive signal, dot pattern data (bitmap data) converted from print data, and so on, to the print engine 31.

For example, the external I/F 32 receives print data formed out of character codes, graphic functions, image data, and the like, from a not-shown host computer. In addition, a busy signal (BUSY) or an acknowledge signal (ACK) is outputted to the host computer or the like via the external I/F 32.

The RAM 33 has a reception buffer, an intermediate buffer, an output buffer and a work memory (not shown). The reception buffer temporarily stores print data received via the external I/F 32. The intermediate buffer stores intermediate code data converted by the controller 11. The output buffer stores dot pattern data. Here, the dot pattern data is print data SI obtained by decoding (translating) the intermediate code data (for example, gradation data).

The ROM 34 stores font data, graphic functions, a look-up table (LUT), etc. as well as the control programs (control routines) for effectuating various data processes. Further, the ROM 34 also stores setting data for maintenance operation, as a maintenance information holding unit. In addition, the ROM 34 (or a not-shown EEPROM) serves as a data storage for a tone confirmation mode to store correction coefficient sets for color adjust values which will be described later.

The controller 11 carries out various controls in accordance with the control programs stored in the ROM 34. For example, the controller 11 reads print data in the reception buffer, converts the print data into intermediate code data, and stores the intermediate code data into the intermediate buffer. In addition, the controller 11 analyzes the intermediate code data read from the intermediate buffer, and converts (decodes) the intermediate code data into dot pattern data with reference to the font data, graphic functions, the look-up table (LUT), and so on stored in the ROM 34, the look-up table being allowed to be corrected by the color adjust values. Then, the controller 11 gives necessary decoration processing to the dot pattern data, and then stores the dot pattern data into the output buffer.

The look-up table (LUT) is a table for converting RGB data (RGB color space) into dot pattern data of CMYK (CMYK color space) in this case.

The color adjust values are, for example, data for compensating a difference in properties as to ink droplet ejection among the nozzle arrays. For example, Japanese Patent Publication No. 10-278350A describes in detail a technique for correcting a look-up table (LUT) using the color adjust values.

When one-line dot pattern data that can be recorded by one-time primary scanning of the recording head 4 is obtained, the one-line dot pattern data is supplied from the output buffer to an electric drive system 39 of the recording head 4 through the internal I/F 37 sequentially. Then, the carriage is moved for scanning, and the line is printed. When the one-line dot pattern data has been outputted from the output buffer, the decoded intermediate code data is deleted from the intermediate buffer, and decoding processing is performed upon the next intermediate code data.

Further, the controller 11 controls the maintenance operation (recovery operation) prior to the recording operation to be performed by the recording head 4.

The print engine 31 is constituted by the paper feeding motor 13 as a paper feed mechanism, the pulse motor 7 as a head scanning mechanism, and the electric drive system 39 of the recording head 4.

Next, description will be made on the electric drive system 39 of the recording head 4. The electric drive system 39 has a decoder 50, a shift register 40, a latch 41, a level shifter 42, a switcher 43 and piezoelectric vibrators 21 connected electrically in series as shown in FIG. 6. These decoder 50, shift register 40, latch 41, level shifter 42, switcher 43 and piezoelectric vibrators 21 are provided for each nozzle orifice 17 of the recording head 4.

In the electric drive system 39, when pulse selection data (SP data) applied to the switcher 43 is "1", the switcher 43 is activated. Thus, the pulse waveform of the drive signal is applied directly to the piezoelectric vibrators 21 so that the piezoelectric vibrators 21 are deformed in accordance with the pulse waveform of the drive signal. On the other hand, when the pulse selection data applied to the switcher 43 is "0", the switcher 43 is deactivated. Thus, the supply of the drive signal to the piezoelectric vibrators 21 is blocked.

In such a manner, a drive signal can be supplied selectively to each piezoelectric vibrator 21 in accordance with the pulse selection data. Thus, in accordance with the given pulse selection data, an ink droplet can be ejected from the nozzle orifice 17, or a meniscus can be finely vibrated.

Figure 7:
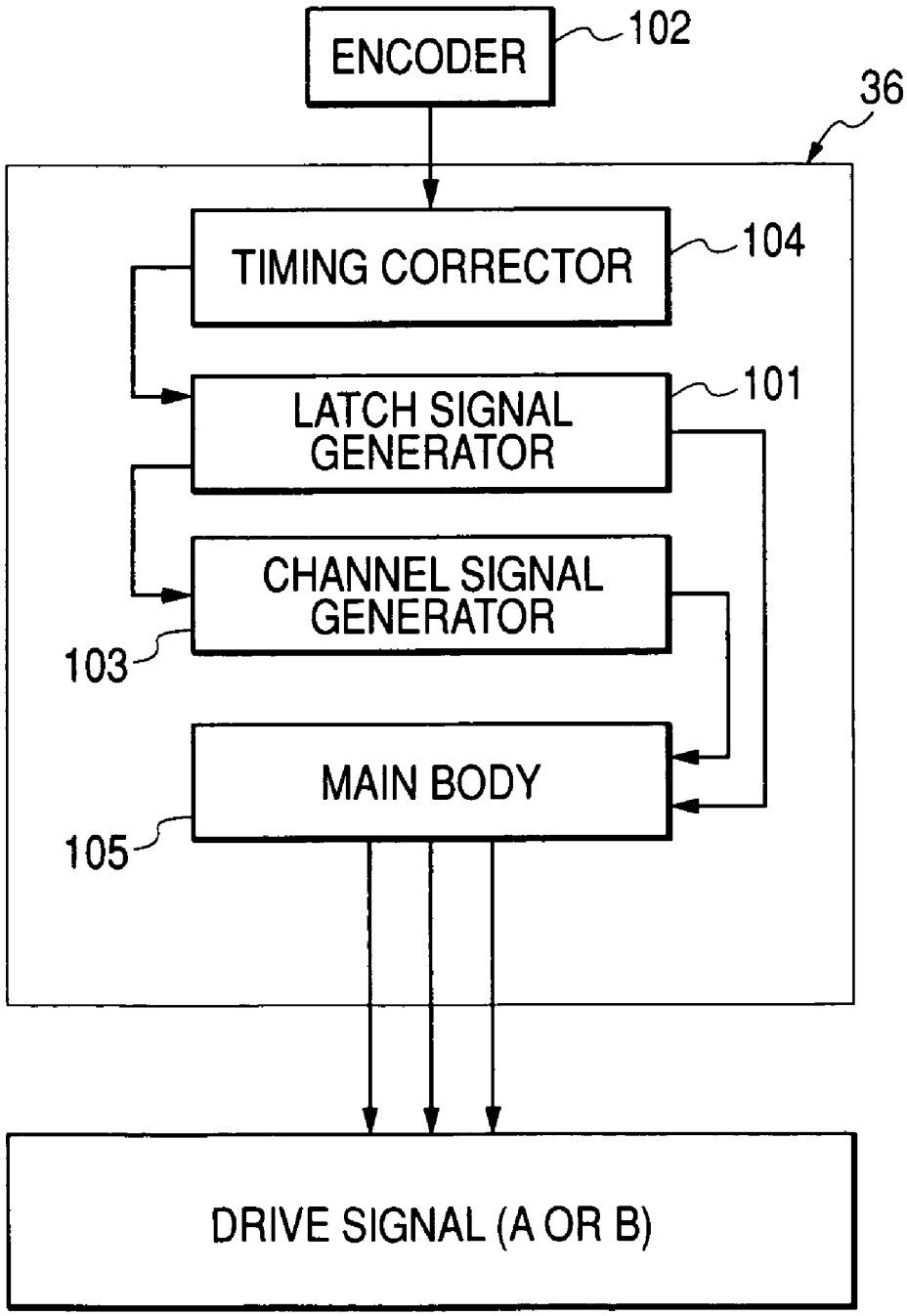
FIG. 7 is a schematic block diagram showing a drive signal generator according to the first embodiment.

Here, the details of the drive signal generator 36 will be described with reference to FIG. 7. As shown in FIG. 7, the drive signal generator 36 has a latch signal generator 101 for outputting a plurality of latch signals LAT in association with the timing at which the recording head 4 passes through each reference position (set for each recording pixel). To the end, the latch signal generator 101 is connected with an encoder 102 through a timing corrector 104. The encoder 102 detects the position or moving distance of the recording head 4 and generates a timing signal TIM.

In addition, the drive signal generator 36 has a channel signal generator 103 for outputting a channel signal CH on the basis of a set time difference with respect to the latch signals LAT. The channel signal CH is outputted after the set time difference has elapsed since each latch signal LAT.

A main body 105 (forward drive signal generator and backward drive signal generator) is connected to the latch signal generator 101 and the channel signal generator 103.

Figure 8:
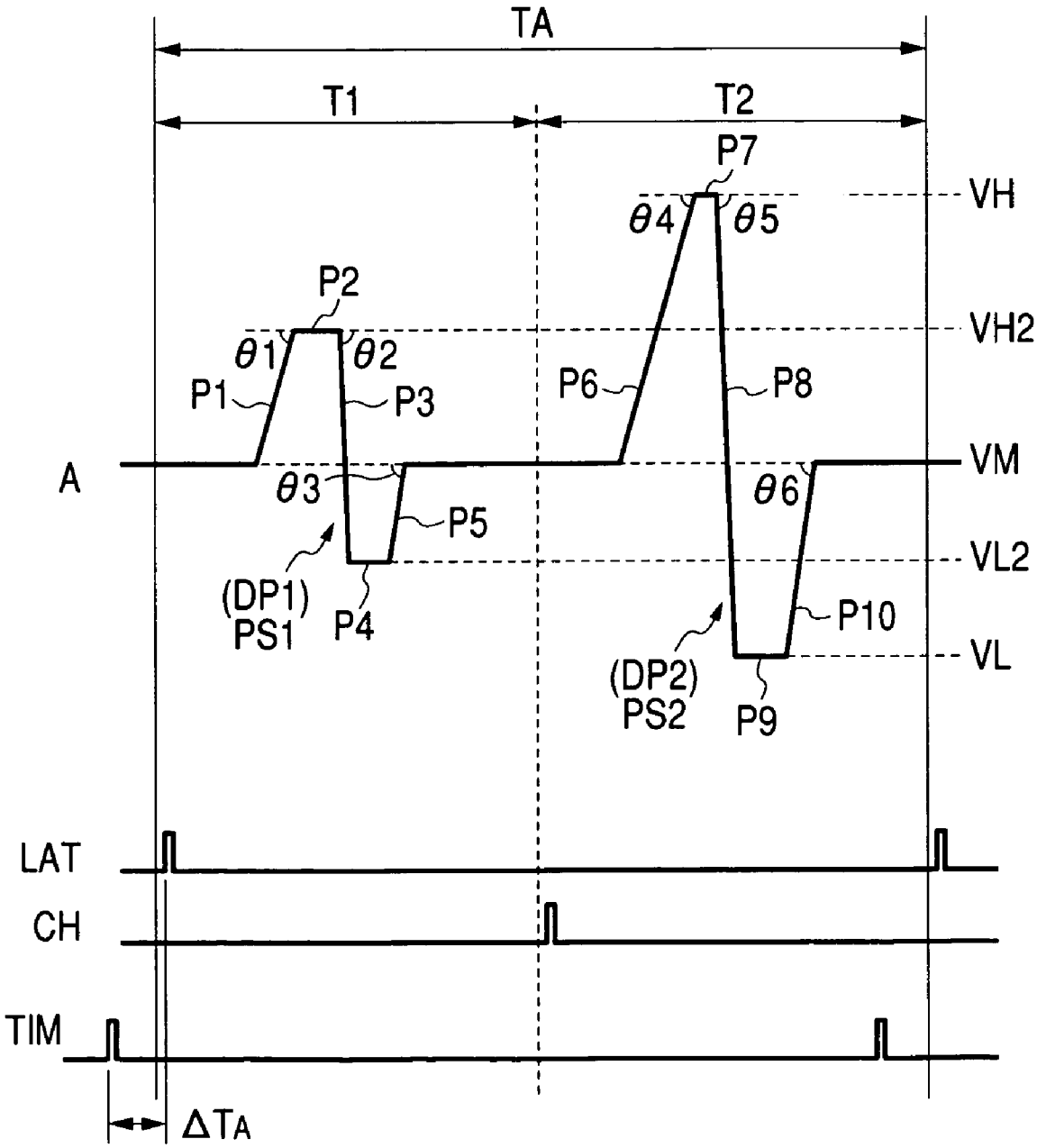
FIG. 8 is a diagram showing an example of a forward drive signal.

During the forward motion of the recording head 4, the main body 105 generates a drive signal A (see FIG. 8) including a latch pulse waveform (first pulse signal PS1 in this case) and a channel pulse waveform (second pulse signal PS2 in this case) in that order. The latch pulse waveform is allowed to appear at output timing at which each latch signal LAT is outputted. The channel pulse waveform is allowed to appear at output timing at which each channel signal CH is outputted by the channel signal generator 103.

Figure 9:
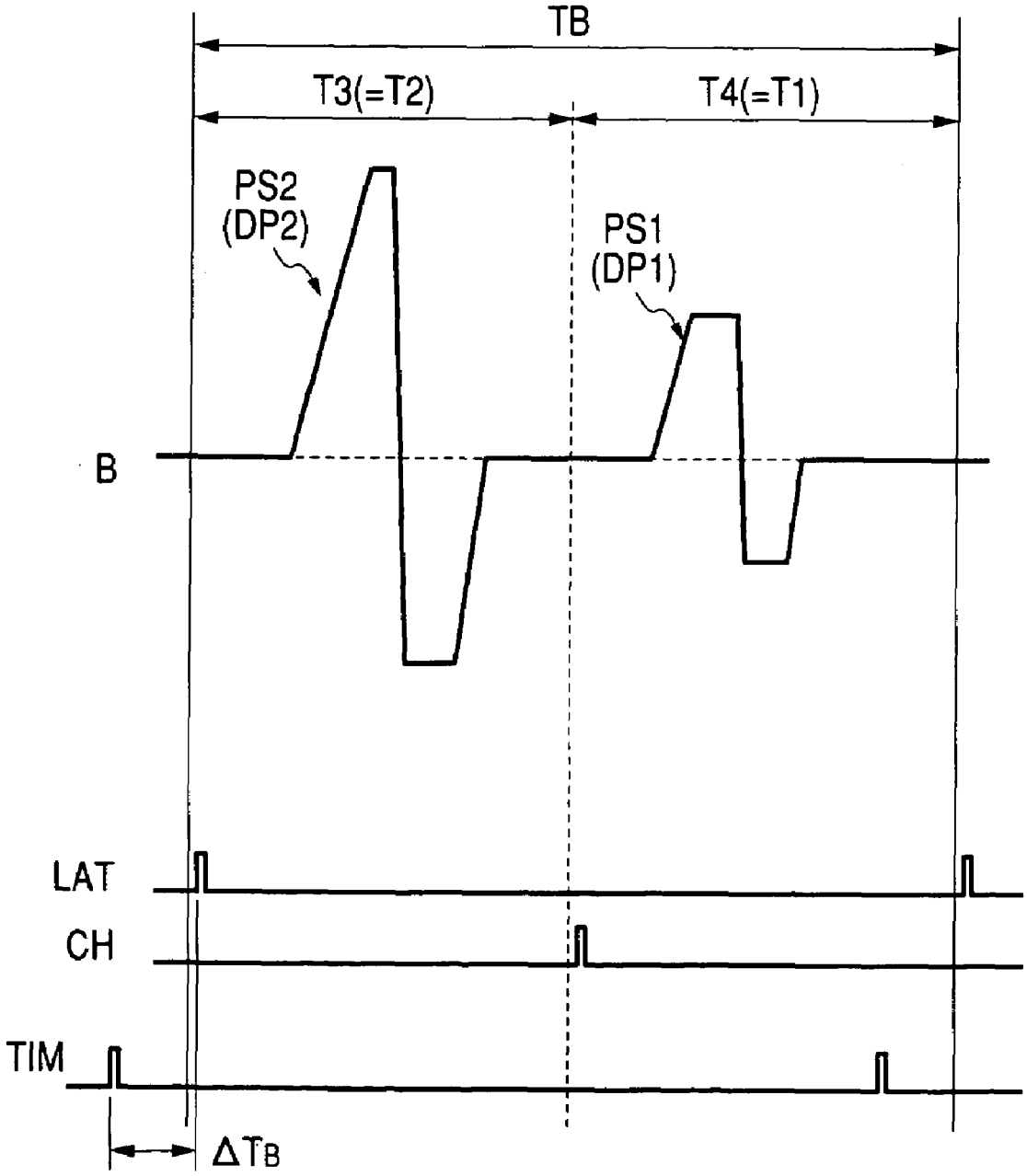
FIG. 9 is a diagram showing an example of a backward drive signal.

On the other hand, during the backward motion of the recording head 4, the main body 105 generates a drive signal B (see FIG. 9) including a latch pulse waveform (second pulse signal PS2 in this case) and a channel pulse waveform (first pulse signal PS1 in this case) in that order. The latch pulse waveform is allowed to appear at output timing at which each latch signal LAT is outputted. The channel pulse waveform is allowed to appear at output timing at which each channel signal CH is outputted by the channel signal generator 103.

During the forward motion and during the backward motion, the timing corrector 104 shifts the output timing of each of the latch signal LAT and the channel signal CH to be sent to the main body 105, uniformly by a time $\Delta T$ (time $\Delta T_A$ or time $\Delta T_B$) with respect to the timing signal TIM.

In this embodiment, the "shift quantity" by the timing corrector 104 is determined by verifying the continuity a vertical ruled line printed during the forward motion and during the backward motion, or verifying the presence/absence of a sense of surface roughness in a patch pattern printed during the forward motion and during the backward motion.

As described previously, mainly for the sake of manufacturing, properties about ink droplet ejection from each nozzle orifice 17 in the head member 4 may differ from one nozzle array to another. In such a case, in order to give a designed value to the quantity of an ink droplet ejected from each nozzle orifice, a "color adjust value" is used in this embodiment.

Specifically, the "color adjust value" is given to each nozzle array, that is, to each ink color on the basis of the properties of ink droplet ejection measured in each nozzle array in advance. For example, when the weight of an ink droplet ejected in the cyan array is 10% larger than its designed value, the color adjust value of the cyan array is set at a value expressing 10%. On the contrary, when the weight of an ink droplet ejected in the yellow array is 10% smaller than its designed value, the color adjust value of the yellow array is set at a value expressing −10%.

Such "color adjust values" may be stored in a not-shown storage mounted on the recording head 4.

Then, the controller 11 as a pattern data adjuster reads the "color adjust value" for each color from the not-shown storage of the recording head 4, and corrects the look-up table (LUT) to adjust the relative ratio of the number of times of ejecting ink droplets per reference area in each nozzle array (for each color) so as to offset the difference in properties of ink droplet ejection among the nozzle arrays (for respective colors).

Dot pattern data in the CMYK color space is generated from the look-up table (LUT) corrected thus, so as to consequently increase/decrease the relative ratio of the number of times of ejecting ink droplets per reference area in each nozzle array (for each color).

Here, the color adjust value will be described in more detail with reference to FIGS. 10 and 11. In this case, as shown in FIG. 10, a color adjust value (ID) is assigned to each ink weight ratio to the designed value of ink weight of an ink droplet to be ejected. Then, as shown in FIG. 11, a color adjust value is set based on the actual ink weight ejected from each nozzle array (BK array, C array, M array and Y array) and the assignment table shown in FIG. 10.

For example, when the ink weight of one droplet is 20 ng, a standard value "50" is set as its ID because it is a value just as designed. When the ink weight of one droplet is 21 ng, a value "55" (5 points higher than the standard value) is set as its ID because it is 5% distant from the designed value. On the contrary, when the ink weight of one droplet is 18 ng, a value "40" (10 points lower than the standard value) is set as its ID because it is −10% distant from the designed value.

The set color adjust ID may be, for example, stored in an ID information storage (not shown) in the recording head 4, or displayed by an ID information indicator (not shown) provided on the recording head 4.

For example, assume that setting is done to eject ink droplets of 20 ng 100 times per reference area to thereby land the ink droplets of 2,000 ng. In this case, by use of such color adjust values, ink droplets are ejected 95 times per reference area in the C array or the Y array whose ink droplet weight is 21 ng. As a result, the ink quantity per reference area reaches 1995 ng therein. Thus, the ink quantity in each array can be substantially trued up with 2000 ng. Likewise as for the M array whose ink droplet weight is 18 ng, ink droplets are ejected 110 times per reference area. Thus, the ink quantity per reference area reaches 1,980 ng, substantially trued up with 2,000 ng.

That is, in this case, in the BK array whose color adjust ID is "50", the weight of an ink droplet takes a value (20 ng)

just as designed. Accordingly, the number of times of ejection per reference area is set at a specified number "100".

On the other hand, in the C array and the Y array whose color adjust ID is "55", the weight of an ink droplet is 5% larger than the specified weight. Accordingly, the number of times of ejection per reference area is reduced by 5% so as to be set at "95".

Likewise, in the M array whose color adjust ID is "40", the weight of an ink droplet is 10% smaller than the specified weight. Accordingly, the number of times of ejection per reference area is increased by 10% so as to be set at "110".

In such a manner, the ejected ink quantity per reference area can be trued up by use of the color adjust values even if there is a difference in the weight of an ejected ink droplet among the nozzle arrays. As a result, an image with fixed quality can be recorded. That is, an image with fixed quality can be recorded in spite of an individual difference in the recording head.

Here, the reference area is an area, for example, corresponding to a fixed 16×16 matrix pattern. Such a pattern is called "dither". Alternatively, the reference area is a variable area determined depending on image data or the like for each portion of each image in consideration of "error diffusion".

Tone adjustment in bi-directional printing can be performed on the printer 1 according to this embodiment by a manufacturer immediately before being shipped as a product or by a user during the use of the printer 1 purchased as a product. To this end, the printer according to this embodiment has a tone confirmation input section 205 to which a tone confirmation command is inputted. In addition, the printer 1 according to this embodiment has a tone confirmation controller 210 for controlling the drive signal generator 36, the controller 11, the head scanning mechanism and the paper feed mechanism in accordance with the tone confirmation command.

The tone confirmation controller 210 forms a plurality of identical solid forward-scanning liquid mixing portions 220 on the recording paper 12. In this embodiment, each of the forward-scanning liquid mixing portions 220 is a gray-color halftone solid pattern formed out of cyan ink, magenta ink and yellow ink.

On the other hand, the tone confirmation controller 210 gradually changes the relative ratio of the number of times of ejecting liquid of each color (each nozzle array) per reference area so as to form a plurality of solid backward-scanning liquid mixing portions 230 (230*a* to 230*h*: see FIG. 12), which are differing slightly in tone from one to another, on the recording paper 12. Each of the backward-scanning mixture patches 230 is also a gray-color halftone solid pattern formed out of cyan ink, magenta ink and yellow ink.

Here, instead of the forward-scanning liquid mixing portions, a plurality of solid forward-scanning liquid mixing portions differing slightly in tone from one to another may be recorded and formed while the relative ratio of the number of times of ejecting liquid per reference area is changed gradually also during backward motion.

The tone confirmation controller 210 in this embodiment corrects the "color adjust value" in each color read by the controller 11. Specifically, for example, the "color adjust value" in each color is multiplied by a correction coefficient set for the color adjust value stored in the ROM 34 or the like in advance. FIG. 13 shows correction coefficient sets for color adjust values by way of example.

Then, the tone confirmation controller 210 according to this embodiment forms a plurality of identical forward-scanning liquid mixing portions 220 as a continuous line in accordance with a tone confirmation command. Likewise the tone confirmation controller 210 forms a plurality of backward-scanning mixture patches 230 (230*a* to 230*h*) as a continuous line. Further, the line of the forward-scanning liquid mixing portions 220 and the line of the backward-scanning mixture patches 230 (230*a* to 230*h*) are made adjacent to each other as shown in FIG. 12.

When the line of the forward-scanning liquid mixing portions 220 and the line of the backward-scanning mixture patches 230 are formed as shown in FIG. 12, one of the backward-scanning mixture patches 230 the most conformable to the tone of the forward-scanning liquid mixing portions 220 can be selected extremely easily.

Incidentally, the work to select one of the backward-scanning mixture patches 230 the most conformable to the tone of the forward-scanning liquid mixing portions 220 may be performed by visual observation of a manufacturer or a user, or by use of a colorimetry device.

The optimum correction coefficients for the color adjust values selected thus are set in an EEPROM, and used in a lump during subsequent backward printing.

In this embodiment, the tone confirmation controller 210 controls the timing corrector 104, the controller 11 and the head scanning mechanism in accordance with a second tone confirmation command so as to form at least one solid forward-scanning liquid mixing portion on the recording paper 12 by driving each piezoelectric vibrator 21 with a fixed forward drive signal, and to form a plurality of solid backward-scanning mixture patches on the recording paper 12 by driving each piezoelectric vibrator 21 with backward drive signals which are different from each other (such a configuration is proposed in the unpublished Japanese Patent Application No. 2002-193337). In this case, it is preferable to perform the control of the tone confirmation controller 210 in accordance with the second tone confirmation command prior to the adjustment of the color adjust values.

Here, when the forward-scanning liquid mixing portion and the backward-scanning mixture patches formed on the recording paper 12 are contrasted with each other, one of the backward-scanning mixture patches the most conformable to the tone of the forward-scanning liquid mixing portion can be selected. Thus, the drive timing (Bi-D adjustment value) corresponding to the selected backward-scanning mixture patch can be set as the drive timing of the pressure fluctuation generator using the backward drive signal.

When tone matching cannot be achieved by such adjustment of the drive timing, it is preferable to perform the control of the tone confirmation controller 210 in accordance with a tone confirmation command.

Figures 14, 15:
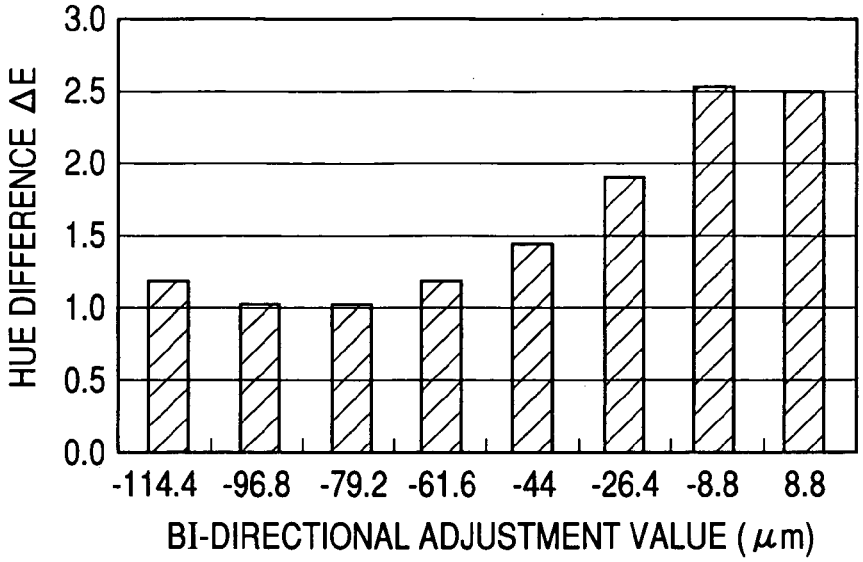
FIG. 14 is a graph showing a data example of tones of several backward-scanning mixture patches estimated by use of a colorimetry device, drive timings of the backward-scanning mixture patches being shifted from one another.
FIG. 15 is a table showing raw data of FIG. 14.

For example, FIG. 14 shows an example of data of tone evaluation on a plurality of backward-scanning mixture patches (shifted in drive timing) with respect to the forward-scanning liquid mixing portions, the evaluation being performed using a colorimetry device. Each forward/backward-scanning mixture patch is specified by the magnitude of shifted drive timing (Bi-D adjustment value).

In the case of FIG. 14, the value −79.2 μm is the most suitable as the Bi-D adjustment value. However, even in that case, the hue difference ΔE is about 1, and the difference in tone cannot be canceled perfectly.

Here, FIG. 15 is a table showing the data for obtaining the graph of FIG. 14. When the value −79.2 μm is adopted as the Bi-D adjustment value, the value of the color axis b* substantially coincides with its reference value, but the value of the color axis a* is +1 larger than its reference value.

Accordingly, in the case shown in FIGS. 14 and 15, it is effective in achieving high-quality color printing to adjust the color adjustment values according to the method of this embodiment as follows. That is, the ejection quantity of magenta ink is suppressed while the ejection quantity of cyan ink is increased. Thus, the value a* is corrected to the minus side.

Incidentally, the positions where the forward-scanning liquid mixing portion 220 and the backward-scanning mixture patches 230 are formed are not limited especially if the forward-scanning liquid mixing portion 220 and the plurality of different backward-scanning mixture patches 230 can be contrasted, preferably contrasted easily.

Figure 16:
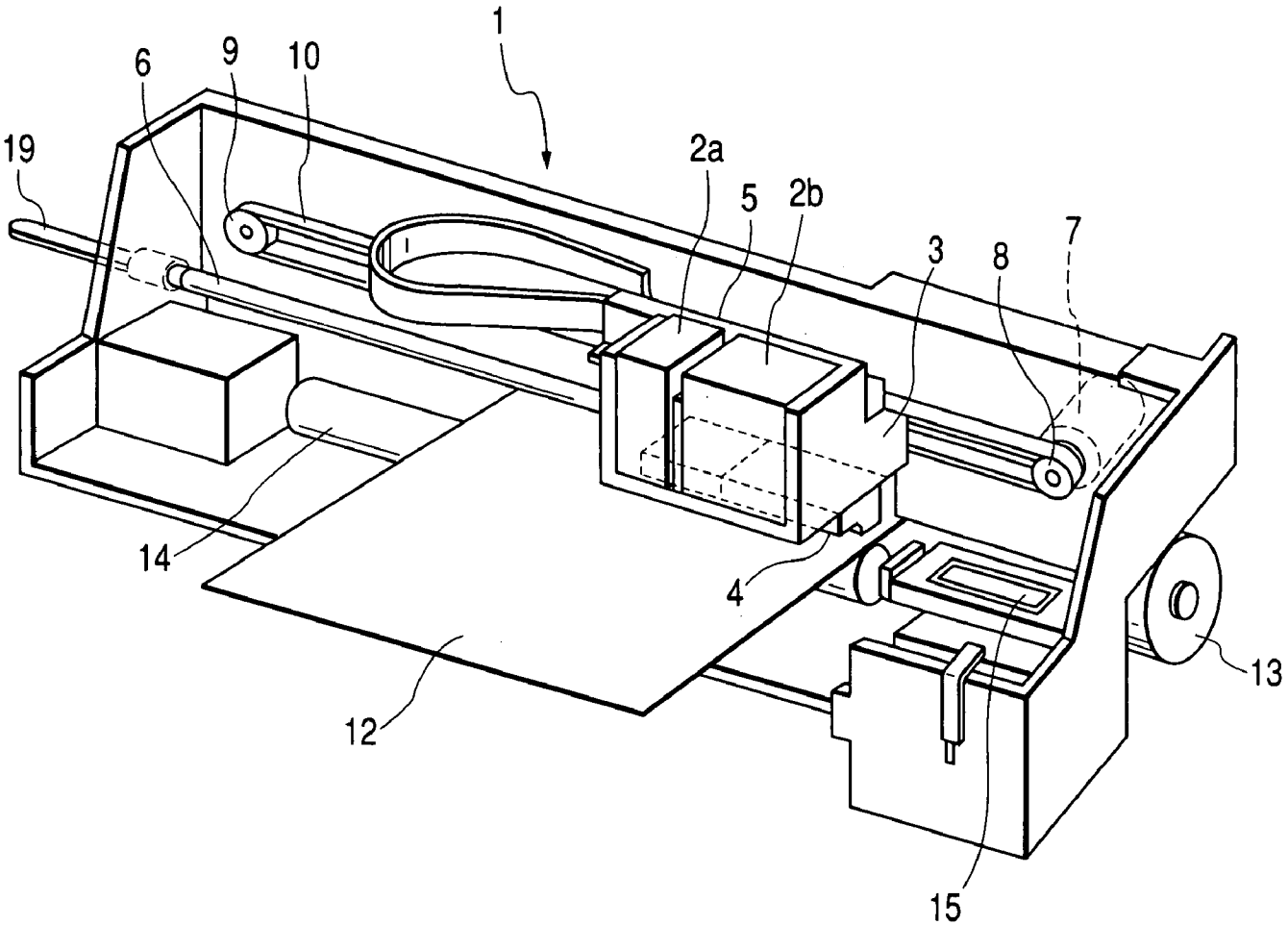
FIG. 16 is a schematic perspective view of ink jet recording apparatus according to a second embodiment of the invention.

In an ink jet printer 1 according to a second embodiment of the invention shown in FIG. 16, a PG adjustment lever 19 capable of switching the position of the guide member 6 vertically in a plurality of stages is attached. The term "PG" means a distance between each nozzle orifice and the recording paper. A user can select a suitable PG in accordance with the thickness of the recording paper to be used, or the degree of deformation of the recording paper.

Members the same as those in the first embodiment are denoted by the same reference numerals correspondingly, and their detailed description will not be omitted.

Figure 17:
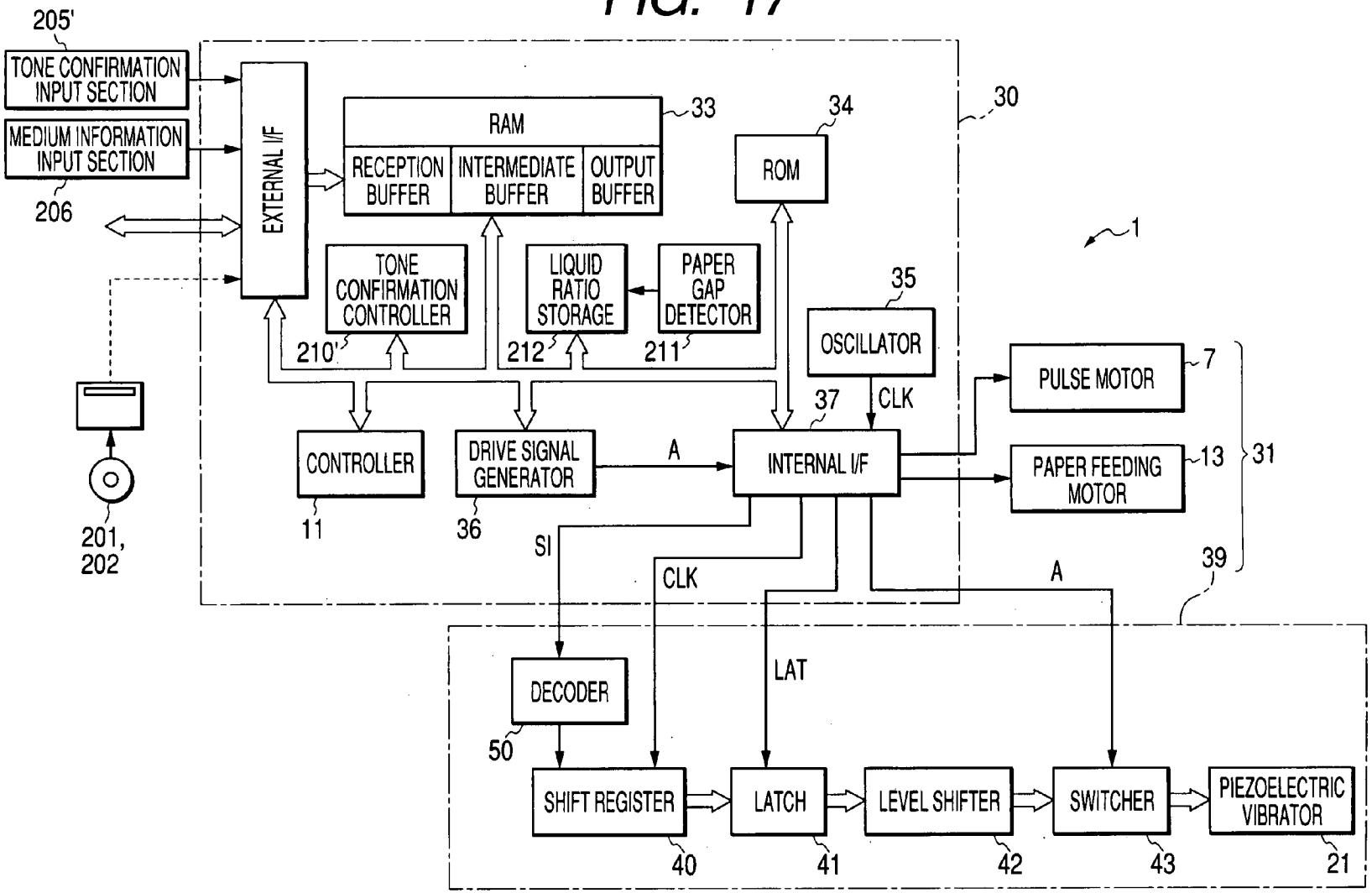
FIG. 17 is a schematic block diagram showing the electric configuration of a recording head according to the second embodiment.

In the printer 1 according to this embodiment, tone adjustment as to the distance (PG) between each nozzle orifice and recording paper is performed by an adjustment worker immediately before the printer 1 is shipped as a product. As shown in FIG. 17, the printer 1 has a tone confirmation input section 205' to which a tone confirmation command is inputted, and a tone confirmation controller 210' for controlling the drive signal generator 36, the controller 11, the head scanning mechanism and the paper feed mechanism in accordance with the tone confirmation command.

Using a drive signal (e.g. drive signal A: see FIG. 8), the tone confirmation controller 210' forms a solid liquid mixing portion on the recording paper 12 having a thickness used as reference, with the PG adjustment lever 19 as a reference position. In this embodiment, the liquid mixing portion is a gray-color halftone solid pattern formed out of cyan ink, magenta ink and yellow ink.

Then, the tone confirmation controller 210' changes the position of the PG adjustment level 19 relatively to the recording paper 12 so as to change the adjustment ratio of the number of times of ejecting liquid of each color (each nozzle array) per reference area gradually. In this case, the adjustment ratio of the number of times of ejecting liquid of each color (each nozzle array) per reference area is increased or reduced gradually relatively. Thus, a plurality of solid liquid mixing portions differing slightly in tone from one to another are formed. Each of the liquid mixing portions is a gray-color halftone solid pattern formed out of cyan ink, magenta ink and yellow ink.

Here, the tone confirmation controller 210' in this embodiment corrects the "color adjust value" in each color read by the controller 11. Specifically, for example, the "color adjust value" in each color is multiplied by a correction coefficient set for the color adjust value stored in the ROM 34 or the like in advance. Such correction coefficient sets for color adjust values are just as shown in FIG. 13 by way of example.

For each position of the PG adjustment lever 19, the adjustment worker selects, from the liquid mixing portions formed on the recording paper 12, one liquid mixing portion the most conformable to the tone of a liquid mixing portion formed on the recording paper 12 by a standard printer. Then, a correction coefficient set for a color adjust value corresponding to the selected liquid mixing portion is set in a liquid ratio storage 212 (see FIG. 17) in association with the thickness of the recording paper 12.

Here, the liquid ratio storage 212 in this embodiment stores the correction coefficient set for the color adjust value in association with the distance (PG) between each nozzle orifice 17 and the recording paper 12. The distance (PG) between each nozzle orifice 17 and the recording paper 12 can be obtained easily by subtracting the thickness of the recording paper 12 from the distance between the moving track (nozzle orifice surface) of the nozzle orifice 17 and the support surface where the recording paper 12 is supported by the paper feed mechanism.

Incidentally, the work to select one liquid mixing portion the most conformable to the tone of the liquid mixing portion formed on the recording paper 12 by the standard printer for each PG adjustment lever position may be performed by visual observation of the adjustment worker or may be performed by means of a colorimetry device.

Figure 19:
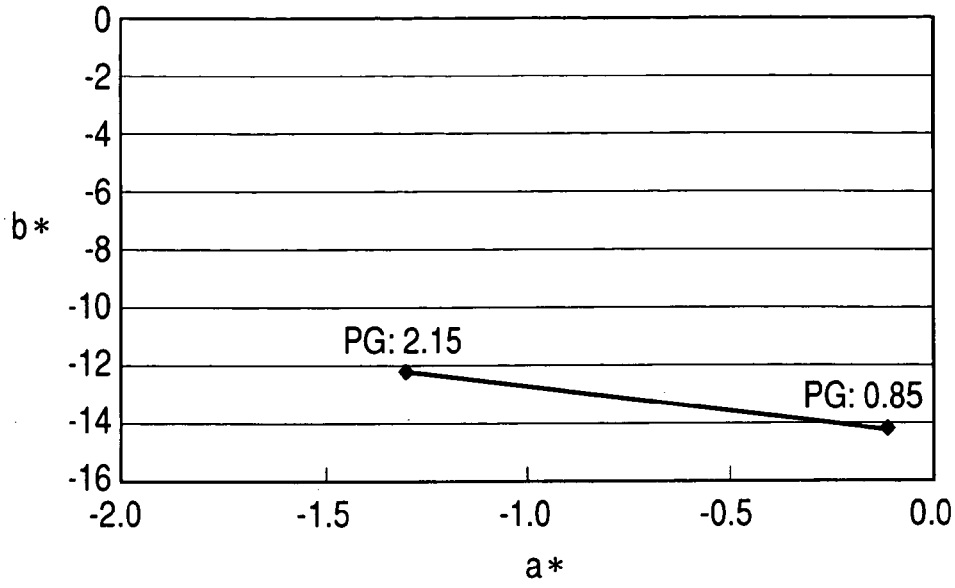
FIG. 19 is a diagram showing a first data example of liquid mixing portions estimated by use of a colorimetry device, the liquid mixing portions being formed on sheets of recording paper different in PG using one and the same color adjust value.

For example, FIG. 19 shows a first data example in which liquid mixing portions formed on recording paper with different PGs using one and the same color adjust value (or a correction coefficient set thereof) are evaluated by use of a colorimetry device. In this example, when PG is increased, the hue changes from the right lower to the left upper in the a*b* color space. This means that the hue changes from one close to magenta to one close to green. Accordingly, in order to bring the hue (tone) upon an increased PG into line with the hue (tone) upon a small PG, it is effective to adjust the color adjust value so as to increase the ejection quantity of magenta ink while suppressing the ejection quantities of yellow ink and cyan ink. Thus, a correction coefficient set for the color adjust value by which such color adjust value adjustment can be achieved is set in the liquid ratio storage 212.

Figure 20:
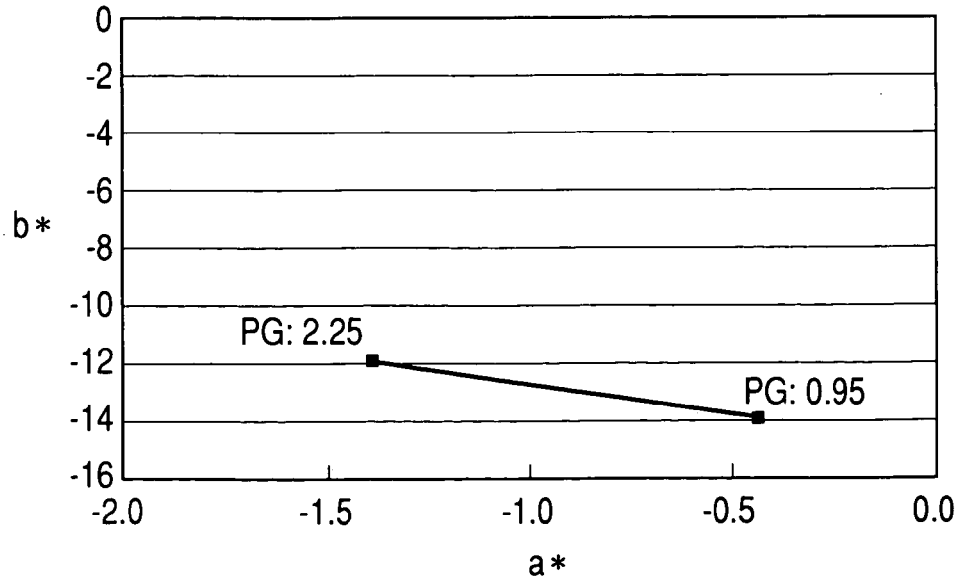
FIG. 20 is a diagram showing a second data example of liquid mixing portions estimated by use of a colorimetry device, the liquid mixing portions being formed on sheets of recording paper different in PG using one and the same color adjust value.
Figure 21:
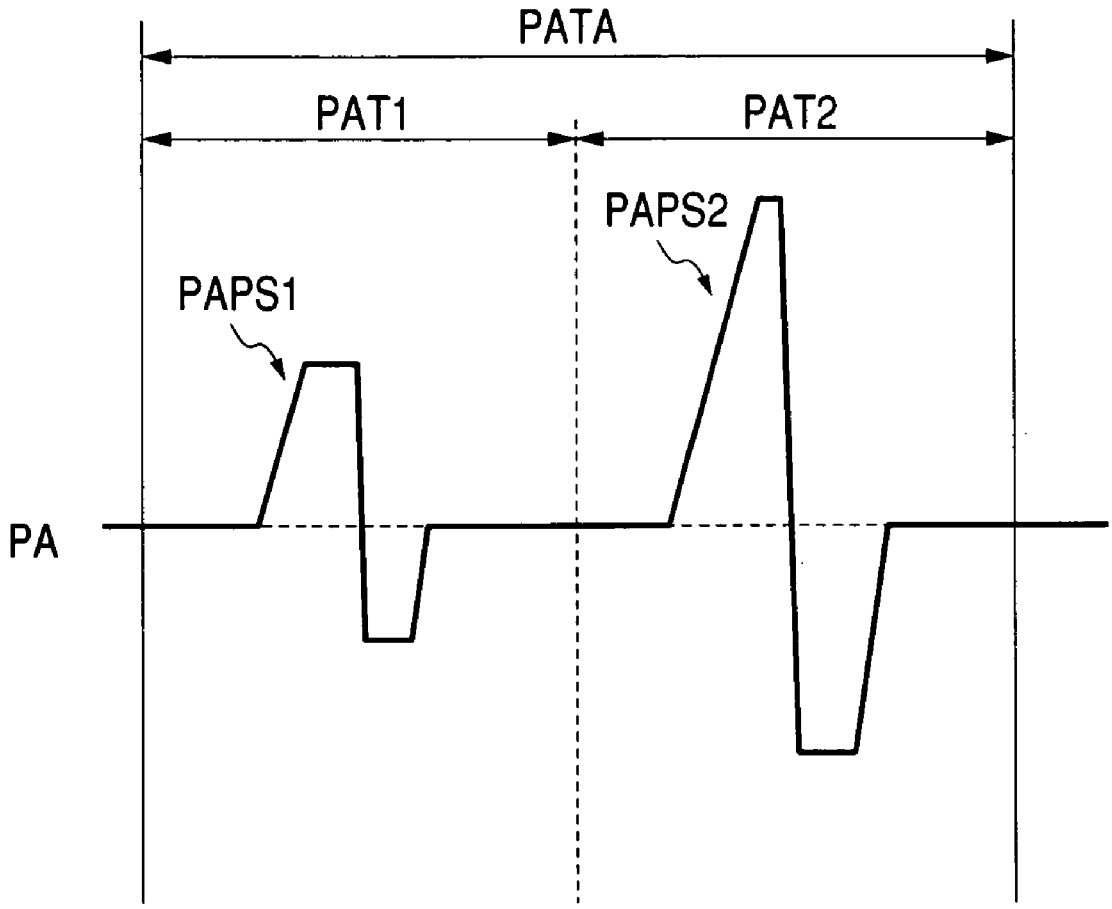
FIG. 21 is a diagram showing an example of a drive signal in the related art.
Figure 22:
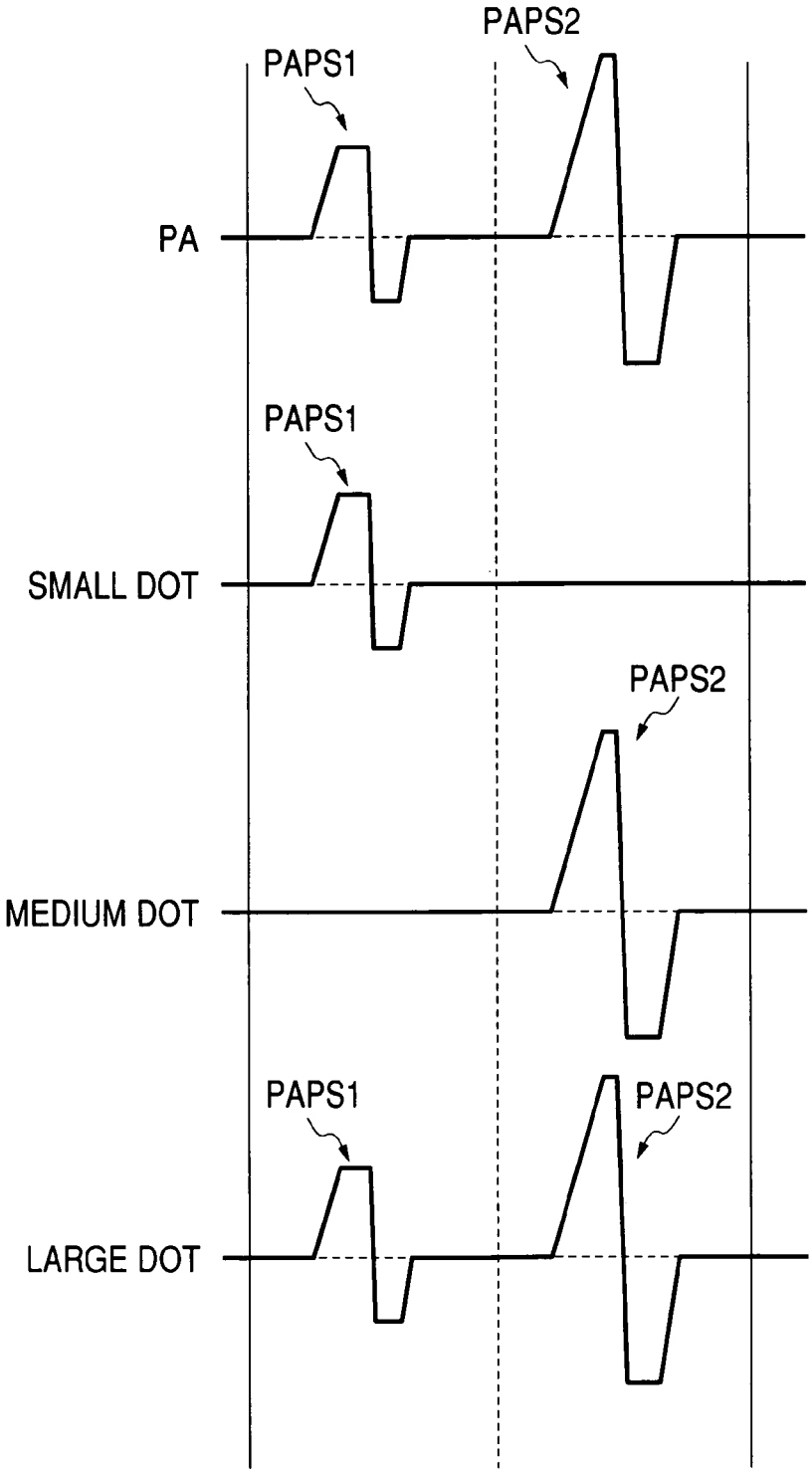
FIG. 22 is a diagram for explaining a driving pulse generated on the basis of the drive signal in FIG. 21.
Figure 23A:
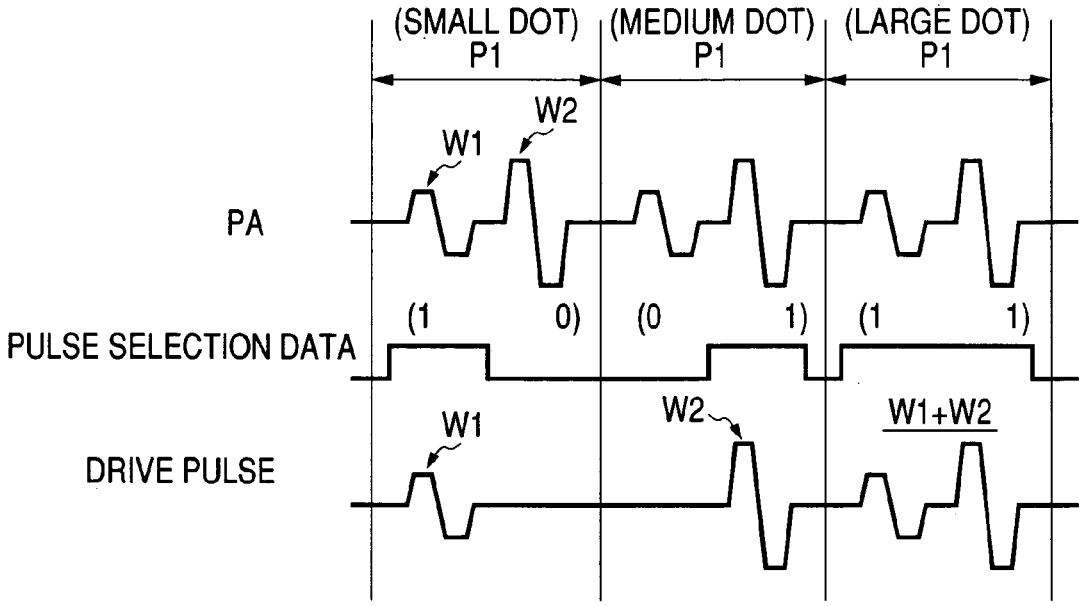
FIGS. 23A and 23B are diagrams for explaining an example in which a forward drive signal and a backward drive signal are made different from each other.
Figure 23B:
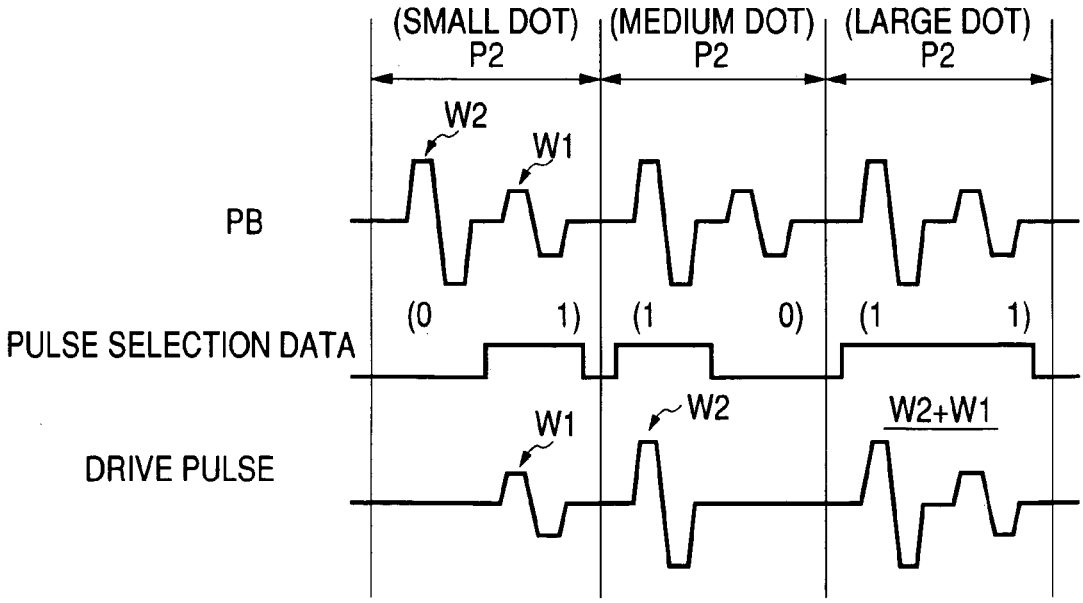
Figure 24:
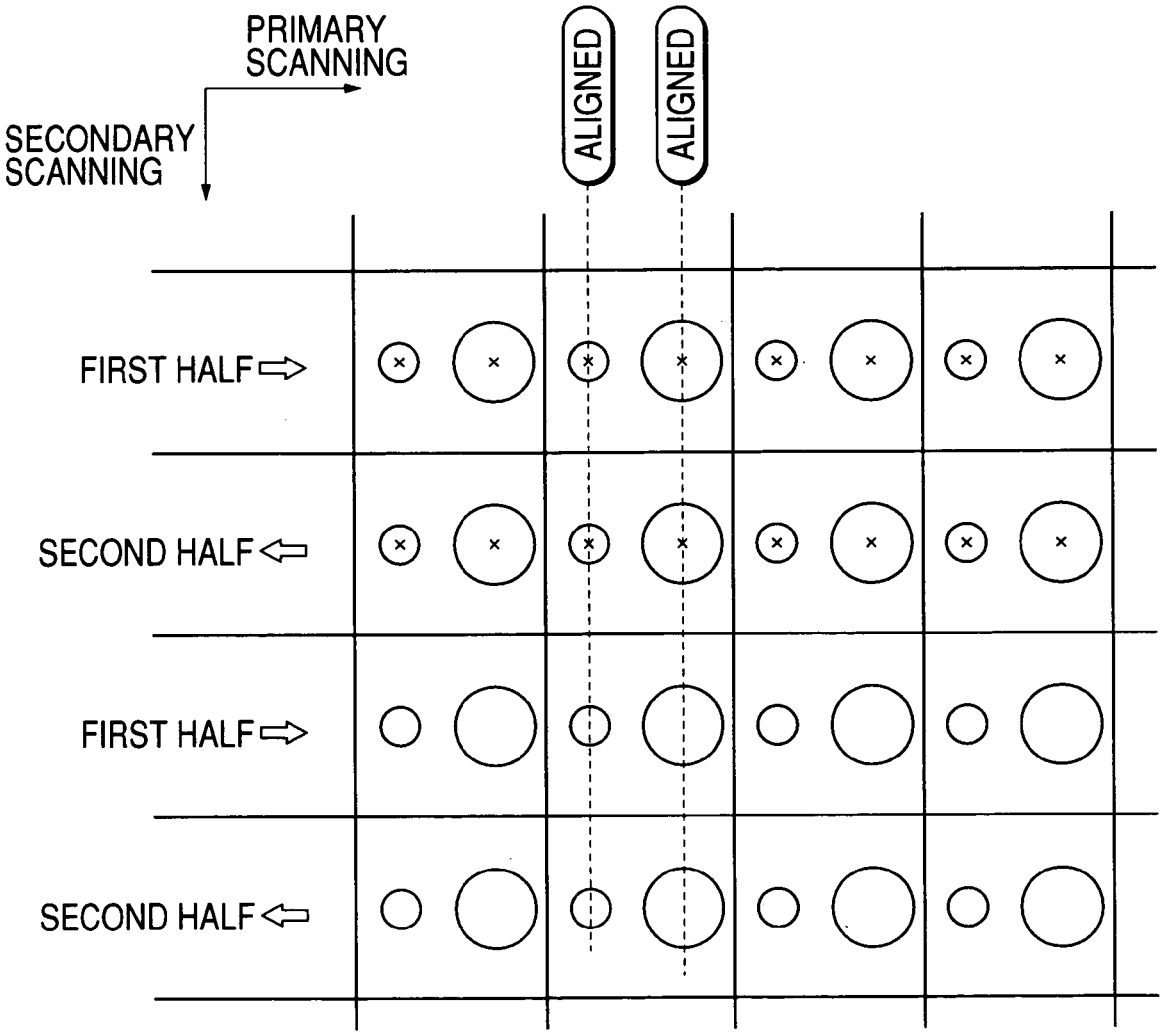
FIG. 24 is a diagram showing the positions where ink droplets are landed in FIGS. 23A and 23B.
Figure 25:
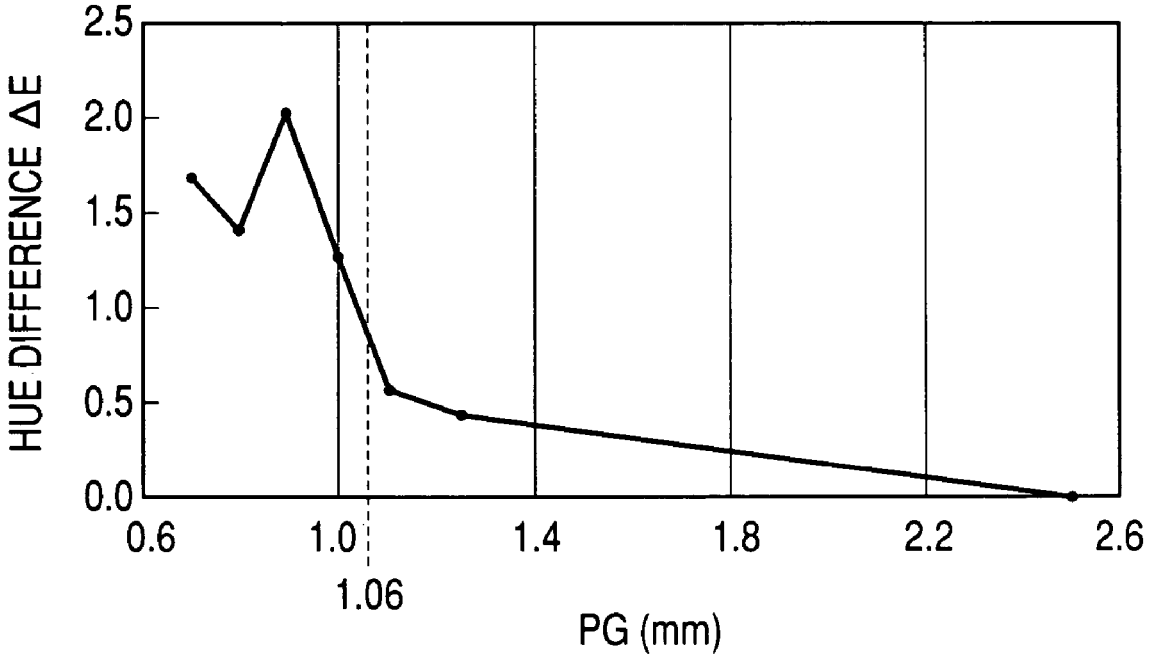
FIG. 25 is a graph for explaining the influence of the distance between each nozzle orifice and recording paper on the difference in hue.

FIG. 20 shows a second data example, to which the aforementioned description is also applied.

The liquid ratio storage 212 in this embodiment stores a correction coefficient set for a color adjust value corresponding to each PG in the form of table data. In a simpler mode, the liquid ratio storage 212 can store such a correction coefficient set for a color adjust value in the form of data binarized with whether the PG is enough to separate a main droplet and a satellite droplet of ink from each other or not.

Data of the recording paper (recording medium) 12 to be used is inputted into the printer 1 in this embodiment by the user during the use of the printer 1 is purchased as a product. To this end, the printer according to this embodiment has a medium information input section 206 to which medium information is inputted (see FIG. 17).

In addition, the printer 1 in this embodiment has a PG detector 211 which derives the thickness of the recording paper 12 from the medium information inputted through the medium information input section 206, and obtains the PG during the use of the recording paper 12 based on the derived thickness of the recording paper 12 and the distance between the moving track of the nozzle orifices 17 and the support surface where the recording paper 12 is supported by the paper feed mechanism (see FIG. 17).

The medium information can be information of the model number of the recording paper 12 or the like as well as information of the thickness of the recording paper 12. In the case of the former, the PG detector 211 stores table data for associating the model number of the recording paper with the thickness of the recording paper or the PG corresponding thereto.

Then, the controller 11 in this embodiment works as a pattern data adjuster to read from the liquid ratio storage 212 a correction coefficient set for a color adjust value corresponding to the PG obtained by the PG detector 211, and to adjust the color adjust value using the correction coefficient set for the color adjust value (see FIG. 17).

Incidentally, a distance sensor for measuring the distance to the surface of the recording paper 12 may be provided in a position of the carriage 5 as high as the nozzle orifices 17, so as to measure the PG directly. Alternatively, a sensor may be attached to the PG adjustment lever 19 so as to acquire PG information.

According to this embodiment, the adjustment ratio of the quantity of each liquid to be jetted from each nozzle orifice, particularly the adjustment ratio of the number of times of ejection of each liquid to be jetted per reference area from each nozzle orifice 17 can be adjusted to a desired increased/reduced ratio using a correction coefficient set for a color adjust value corresponding to the PG identified by the PG detector 211. As a result, the change of landing properties caused by the overlapping between a main droplet and a satellite droplet in each liquid when the main and satellite droplets are landed, and hence the change in tone in this case can be compensated properly.

Figure 18:
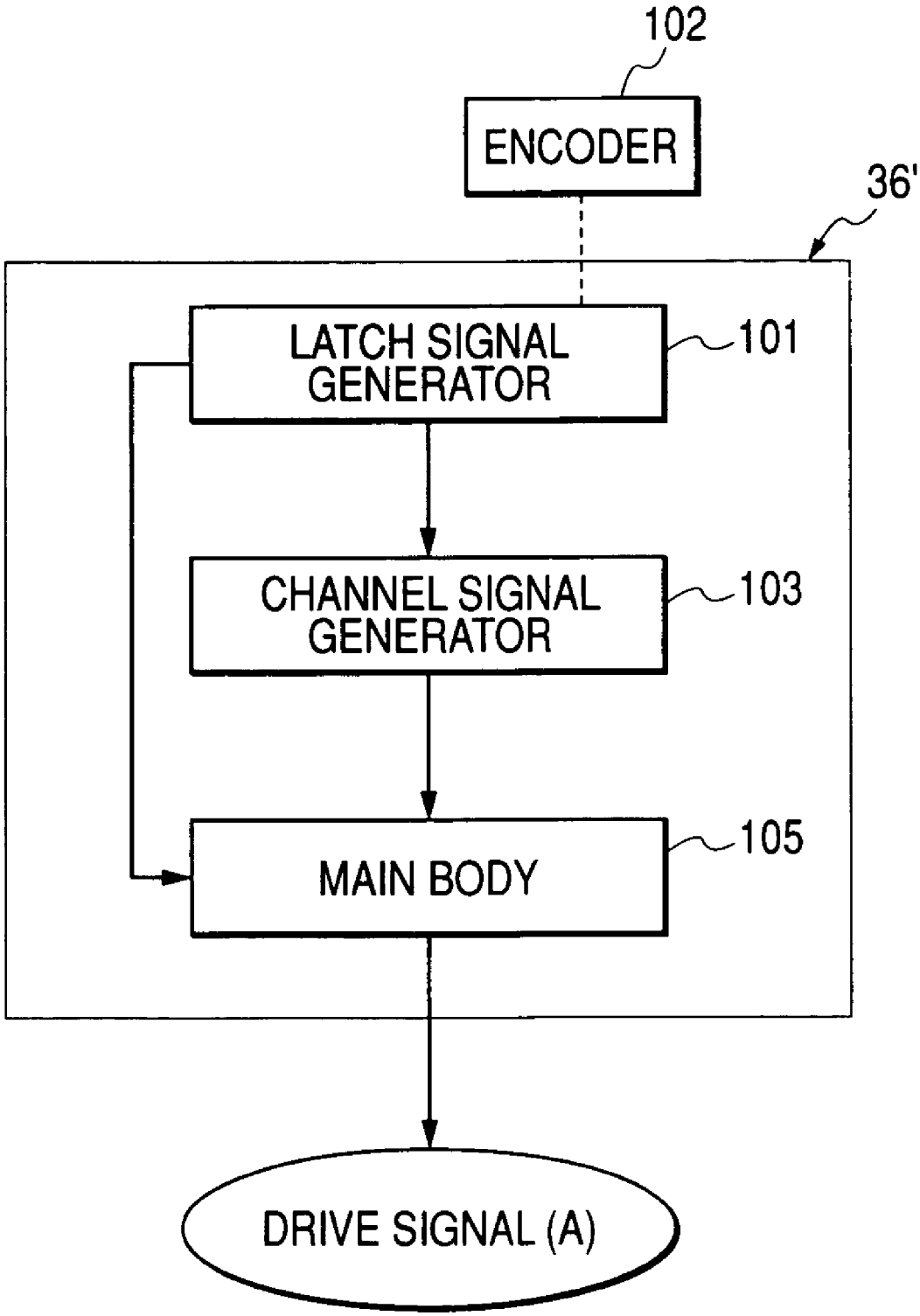
FIG. 18 is a schematic block diagram showing a drive signal generator according to the second embodiment.

This embodiment is also applicable to a printer carrying out unidirectional recording. Therefore, the drive signal generator 36 in FIG. 17 can be arranged as a drive signal generator 36' in which the timing corrector 104 has been omitted from the drive signal generator 36 in the first embodiment, as shown in FIG. 18.

In the above description, a pressure generating element (pressure fluctuation generator) for changing the volume of the pressure chamber 22 is not limited to the piezoelectric vibrator 21. For example, a magnetostrictive element may be used as a pressure generating element so that a change of pressure is generated in the pressure chamber 22 expanded/contracted by the magnetostrictive element. Alternatively, a heating element may be used as a pressure generating element so that the pressure fluctuation is generated in the pressure chamber 22 due to bubbles expanded/contracted by heat from the heating element.

Incidentally, as described previously, the printer controller 30 can be constituted by a computer system. A program for allowing the computer system to implement each of the aforementioned elements, and a computer-readable recording medium 201 in which the program is recorded are also included in the scope of protection of the invention.

Further, when each of the aforementioned elements is implemented by a program such as an OS and the like operating on the computer system, a program including various commands for controlling the program such as the OS and the like, and a recording medium 202 recording the program are also included in the scope of protection of the invention.

Here, each of the recording media 201 and 202 includes a network propagating various signals as well as a medium that can be recognized as a unit such as a floppy disk.

Incidentally, although the above description was made on the ink jet recording apparatus, the invention is aimed widely at the general liquid ejection apparatus. Examples of liquids may include glue and manicure as well as ink.

What is claimed is:

1. A liquid ejection apparatus, comprising:

a head member, provided with nozzles including a plurality of nozzle groups each associated with one of a plurality of colors of liquid;

a plurality of pressure fluctuation generators, each of which is operable to generate pressure fluctuation in liquid in each of the nozzles to eject a liquid droplet therefrom;

a carriage, operable to carry the head member so as to reciprocately transverse a first region in which a medium, on which the liquid droplet is landed, is placed;

a signal generator, operable to generate a first signal and a second signal;

a controller, operable to drive the pressure fluctuation generator according to the first signal and ejection pattern data in a case where the head member transverse the first region in a first direction, and to drive the pressure fluctuation generator according to the second signal and the ejection pattern data in a case where the head member transverse the first region in a second direction opposite to the first direction; and a pattern data adjuster, operable to adjust ejection pattern data so as to vary an ejected number of the liquid droplets per unit area, for each of the nozzle groups wherein the pattern data adjuster adjusts the ejection pattern data so as to vary relative percentages among liquid droplets of the respective colors in all liquid droplets ejected in the unit area.

2. The liquid ejection apparatus as set forth in claim 1, wherein the first signal and the second signal are different from each other.

3. The liquid ejection apparatus as set forth in claim 1, wherein the first signal and the second signal are identical with each other.

4. The liquid ejection apparatus as set forth in claim 1, further comprising a tone confirmation controller, operable to control the pattern data adjuster, the controller and the carriage such that:

at least one first liquid mixing portion, at which liquid droplets of the plural colors are superposed, is formed on the medium when the head member transverses the first region in the first direction; and a plurality of second liquid mixing portions, at which liquid droplets of the plural colors are superposed while varying the ejected number of the liquid droplets per unit area, are formed on the medium when the head member transverse the first region in the second direction, wherein the first liquid mixing portion and the second liquid mixing portions are arranged on the medium in a comparative manner.

5. The liquid ejection apparatus as set forth in claim 4, wherein a plurality of first liquid mixing portions are formed.

6. The liquid ejection apparatus as set forth in claim 5, wherein the first liquid mixing portions are formed by superposing liquid droplets of the plural colors while varying the ejected number of the liquid droplet per the unit area, when the head member transverses the first region in the first direction.

7. The liquid ejection apparatus as set forth in claim 4, wherein:

the medium is placed in the first region movably in a third direction perpendicular to the first direction and the second direction;

the second liquid mixing portions are arranged in the second direction; and the first liquid mixing portion and the second liquid mixing portions are adjacent in the third direction.

8. The liquid ejection apparatus as set forth in claim 4, wherein:

the medium is placed in the first region movably in a third direction perpendicular to the first direction and the second direction;

the second liquid mixing portions are arranged in the third direction; and the first liquid mixing portion and the second liquid mixing portions are adjacent in the second direction.

9. The liquid ejection apparatus as set forth in claim 1, wherein the nozzle groups are at least three groups respectively associated with cyan liquid, magenta liquid and yellow liquid.

10. The liquid ejection apparatus as set forth in claim 1, wherein the unit area includes a matrix pattern constituted by a plurality of pixels each of which is associated with one liquid droplet.

11. The liquid ejection apparatus as set forth in claim 1, wherein a size of the unit area is variable according to the ejection pattern data.

12. A method of adjusting the ejected number of the liquid droplet per the unit area, performed in the liquid ejection apparatus as set forth in claim 1, comprising steps of:

forming at least one first liquid mixing portion, at which liquid droplets of the plural colors are superposed, on the medium when the head member transverses the first region in the first direction;

forming a plurality of second liquid mixing portions, at which liquid droplets of the plural colors are superposed while varying the ejected number of the liquid droplets per unit area, on the medium when the head member transverse the first region in the second direction;

comparing the second liquid mixing portions with the first liquid mixing portion to select one of the second liquid mixing portions having a tone closest to a tone of the first liquid mixing portion; and adjusting the ejection pattern data so as to correspond to an ejected number of the liquid droplets per unit area which is associated with the selected one of the second liquid mixing portions.

13. The adjusting method as set forth in claim 12, wherein the comparing step is performed with operator's eyes.

14. The adjusting method as set forth in claim 12, wherein the comparing step is performed with a colorimetry device.

15. The adjusting method as set forth in claim 12, further comprising steps of:

forming a plurality of third liquid mixing portions, at which liquid droplets of the plural colors are superposed while varying the ejected number of the liquid droplets per unit area, on the medium when the head member transverses the first region in the first direction;

comparing the third liquid mixing portions with the first liquid mixing portion to select one of the second liquid mixing portions having a tone closest to a tone of the first liquid mixing portion; and adjusting the ejection pattern data so as to correspond to an ejected number of the liquid droplets per unit area which is associated with the selected one of the third liquid mixing portions.

16. The liquid ejection apparatus as set forth in claim 1, wherein the pattern data adjuster controls the ejection pattern data for tone correction of a liquid droplet that has a tone that deviates from a pre-determined tone by a pre-determined amount.

17. An apparatus for controlling a liquid ejection apparatus, which comprises:

a head member, provided with nozzles including a plurality of nozzle groups each associated with one of a plurality of colors of liquid;

a plurality of pressure fluctuation generators, each of which is operable to generate pressure fluctuation in liquid in each of the nozzles to eject a liquid droplet therefrom; and a carriage, operable to carry the head member so as to reciprocately transverse a first region in which a medium, on which the liquid droplet is landed, is placed, the controlling apparatus comprising:

a signal generator, operable to generate a first signal and a second signal;

a controller, operable to drive the pressure fluctuation generator according to the first signal and ejection pattern data in a case where the head member transverse the first region in a first direction, and to drive the pressure fluctuation generator according to the second signal and the ejection pattern data in a case where the head member transverse the first region in a second direction opposite to the first direction; and a pattern data adjuster, operable to adjust ejection pattern data so as to vary an ejected number of the liquid droplets per unit area, for each of the nozzle groups wherein the pattern data adjuster adjusts the ejection pattern data so as to vary relative percentages among liquid droplets of the respective colors in all liquid droplets ejected in the unit area.

18. The controlling apparatus as set forth in claim 17, wherein the first signal and the second signal are different from each other.

19. The controlling apparatus as set forth in claim 17, wherein the first signal and the second signal are identical with each other.

20. The controlling apparatus as set forth in claim 17, further comprising a tone confirmation controller, operable to control the pattern data adjuster, the controller and the carriage such that:

at least one first liquid mixing portion, at which liquid droplets of the plural colors are superposed, is formed on the medium when the head member transverses the first region in the first direction; and a plurality of second liquid mixing portions, at which liquid droplets of the plural colors are superposed while varying the ejected number of the liquid droplets per unit area, are formed on the medium when the head member transverse the first region in the second direction, wherein the first liquid mixing portion and the second liquid mixing portions are arranged on the medium in a comparative manner.

21. The controlling apparatus as set forth in claim 20, wherein a plurality of first liquid mixing portions are formed.

22. The liquid ejection apparatus as set forth in claim 21, wherein the first liquid mixing portions are formed by superposing liquid droplets of the plural colors while varying the ejected number of the liquid droplets per unit area, when the head member transverses the first region in the first direction.

23. The controlling apparatus as set forth in claim 20, wherein:

the medium is placed in the first region movably in a third direction perpendicular to the first direction and the second direction;

the second liquid mixing portions are arranged in the second direction; and the first liquid mixing portion and the second liquid mixing portions are adjacent in the third direction.

24. The liquid ejection apparatus as set forth in claim 20, wherein:

the medium is placed in the first region movably in a third direction perpendicular to the first direction and the second direction;

the second liquid mixing portions are arranged in the third direction; and the first liquid mixing portion and the second liquid mixing portions are adjacent in the second direction.

25. The controlling apparatus as set forth in claim 17, wherein the unit area includes a matrix pattern constituted by a plurality of pixels each of which is associated with one liquid droplet.

26. The controlling apparatus as set forth in claim 17, wherein a size of the unit area is variable according to the ejection pattern data.

27. The liquid ejection apparatus as set forth in claim 17, wherein the pattern data adjuster controls the ejection pattern data for tone correction of a tone that deviates from a pre-determined tone.

* * * * *